US010809665B2

(12) United States Patent
Koike

(10) Patent No.: US 10,809,665 B2
(45) Date of Patent: Oct. 20, 2020

(54) TIMEPIECE MOVEMENT

(71) Applicant: Seiko Epson Corporation, Tokyo (JP)

(72) Inventor: Nobuhiro Koike, Chino (JP)

(73) Assignee: Seiko Epson Corporation (JP)

( * ) Notice: Subject to any disclaimer, the term of this patent is extended or adjusted under 35 U.S.C. 154(b) by 235 days.

(21) Appl. No.: 15/997,006

(22) Filed: Jun. 4, 2018

(65) Prior Publication Data

US 2018/0348706 A1 Dec. 6, 2018

(30) Foreign Application Priority Data

Jun. 5, 2017 (JP) ..... 2017-111053

(51) Int. Cl.

| | |
|---|---|
| ***G04B 19/26*** | (2006.01) |
| ***G04B 19/06*** | (2006.01) |
| ***G04B 19/24*** | (2006.01) |
| ***G04B 19/247*** | (2006.01) |

(52) U.S. Cl.
CPC ..... *G04B 19/268* (2013.01); *G04B 19/065* (2013.01); *G04B 19/241* (2013.01); *G04B 19/247* (2013.01)

(58) Field of Classification Search
CPC ..... G04B 19/065; G04B 19/24; G04B 19/26
See application file for complete search history.

(56) References Cited

U.S. PATENT DOCUMENTS

| | | | | |
|---|---|---|---|---|
| 1,997,511 | A * | 4/1935 | Canepa | G04B 19/268 368/18 |
| 5,222,051 | A * | 6/1993 | Dubois | G04B 19/266 368/19 |
| 7,251,198 | B2 * | 7/2007 | Barton | G09D 3/08 368/18 |
| 2009/0274010 | A1 | 11/2009 | Vuilleumier et al. | |
| 2013/0070574 | A1 * | 3/2013 | Takasawa | G04B 19/046 368/239 |
| 2013/0336096 | A1 | 12/2013 | Grossenbacher et al. | |

FOREIGN PATENT DOCUMENTS

| | | | |
|---|---|---|---|
| CH | 702354 | A2 | 6/2011 |
| EP | 1677165 | A1 | 7/2006 |
| EP | 2674818 | A1 | 12/2013 |
| JP | 2010-243160 | A | 10/2010 |
| JP | 2016-057270 | A | 4/2016 |

OTHER PUBLICATIONS

Extended European Search Report for Patent Application No. EP18175719.6 dated Nov. 19, 2018 (6 pages).

* cited by examiner

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

A timepiece movement includes a date indicator for date display, a date indicator driving wheel for advancing the date indicator, a lunar age indicator for lunar age display, and a lunar age indicator driving wheel for rotating the lunar age indicator. The date indicator and the lunar age indicator are coaxially disposed, and the date indicator driving wheel and the lunar age indicator driving wheel are coaxially disposed.

9 Claims, 28 Drawing Sheets

TIMEPIECE MOVEMENT

BACKGROUND

1. Technical Field

The present invention relates to a timepiece movement.

2. Related Art

As a timepiece of related art, there is a timepiece which includes a main plate that serves as a base frame of a movement for driving the timepiece and in which the main plate guides a date indicator for date display, a date indicator driving wheel for rotating the date indicator, a day display indicator for day display, and a day indicator driving wheel for rotating the day display indicator on a geared wheel basis (see JP-A-2010-243160).

As a timepiece of related art, improvement in the added value of the timepiece has been attempted by adding a variety of display functions, such as a date display function, a day display function, and a lunar age display function, in addition to time display. To this end, it is necessary to provide drive train wheels for the display indicators for the functions described above, and it is also desirable to provide independent correction train wheels for the display indicators. It is, however, necessary to add a new correction train wheel whenever a new display indicator associated therewith is added, and there are many layout restrictions.

SUMMARY

An advantage of some aspects of the invention is to provide a timepiece movement that readily allows addition of a function through space saving in a plan view.

A timepiece movement according to an aspect of the invention includes a first display wheel for first display, a second display wheel for second display, a first driving wheel that engages with and rotates the first display wheel, and a second driving wheel that engages with and rotates the second display wheel. The first display wheel and the second display wheel are coaxially disposed, and the first driving wheel and the second driving wheel are coaxially disposed.

According to the timepiece movement described above, since the first display wheel and the second display wheel are coaxially disposed, and the first driving wheel and the second driving wheel are coaxially disposed, these geared wheels overlap with one another in the plan view for space saving. As a result, for example, functions or decorations for improvement in added value, such as a larger number of display functions and partial skeletons, can be added.

It is preferable that the timepiece movement according to the aspect of the invention further includes a first pressing member provided between the first display wheel and the second display wheel and a second pressing member that presses the second display wheel from a side facing a front surface thereof, that the second display wheel is guided coaxially with the first display wheel in a region between the first pressing member and the second pressing member by a guide section provided in the first pressing member and is so disposed as to be axially separate from the first display wheel, and that the first display wheel and the second display wheel separately pivot.

In the timepiece movement according to the aspect described above, the first display wheel and the second display wheel, which are so disposed as to be axially separate from each other and are allowed to pivot separately, can contribute to space saving in the plan view.

It is preferable that the timepiece movement according to the aspect of the invention further includes a second display wheel guide seating so provided on a side of the second display wheel, the side facing the first pressing member, as to be slidable relative to at least one of the first pressing member and the second pressing member, that the first pressing member has a tubular section as the guide section so provided as to axially protrude into a tubular shape coaxial with the first display wheel, that the second display wheel guide seating is guided by the tubular section coaxially with the first display wheel, and that the second display wheel is attached coaxially with the second display wheel guide seating.

In the timepiece movement according to the aspect described above, the first display wheel and the second display wheel are so disposed by the first pressing member and the second display wheel guide seating as to be axially separate from each other and therefore pivot separately, contributing to space saving in the plan view.

In the timepiece movement according to the aspect of the invention, it is preferable that one of the first driving wheel and the second driving wheel has a dowel so formed as to axially protrude, that another one of the first driving wheel and the second driving wheel has a dowel receiving hole into which the dowel is inserted, that the dowel of the first driving wheel or the second driving wheel is inserted into the dowel receiving hole in the second driving wheel or the first driving wheel, and that one of the first driving wheel and the second driving wheel is provided with a toothed section that engages with another geared wheel.

In the timepiece movement according to the aspect described above, when the toothed section engages with another geared wheel (intermediate date wheel, for example) and the rotary force is transferred from the other geared wheel to the toothed section, the rotary force transmitted by the dowel and the dowel receiving hole allows simultaneous rotation of the first driving wheel and the second driving wheel. Providing one of the first driving wheel and the second driving wheel with the toothed section therefore eliminates the need to provide the other driving wheel with a toothed section for engagement with another geared wheel and transmission of rotary force from the intermediate date wheel or any other component, whereby the axial thickness of the movement can be reduced as compared with a case where the other driving wheel is provided with a toothed section. Further, the positional relationship between the first driving wheel and the second driving wheel can be changed by changing the position of the dowel or the dowel receiving hole. The phase between the first driving wheel and the second driving wheel can therefore be readily adjusted.

It is preferable that the timepiece movement according to the aspect described above further includes a correction transfer lever that includes a transfer lever main plate section and a reception section pressed by a pressing section and is so provided in the movement as to be pivotable around a first fixing member as a pivotal axis perpendicularly to an axial direction of the pivotal axis and a correction lever that includes a correction lever main plate section and a correction section that comes into contact with a tooth of the second display wheel, is so provided in the movement as to be pivotable around a second fixing member as a pivotal axis perpendicularly to an axial direction of the pivotal axis, and causes the second display wheel to pivot, that one of the correction transfer lever and the correction lever has an engagement section so provided as to protrude toward another of the correction transfer lever and the correction lever or a reception hole that engages with the engagement section, that the transfer lever main plate section and the correction lever main plate section are so disposed as to be parallel to a plane perpendicular to the axial direction, and that when the reception section of the correction transfer lever is pressed by the pressing member so that the correction transfer lever pivots, the correction lever pivots and the correction section of the correction lever therefore comes into contact with a tooth of the second display wheel so that the second display wheel pivots.

According to the aspect described above, the transfer lever main plate section and the correction lever main plate section are so disposed as to be parallel to a plane perpendicular to the axial direction, and the engagement section transfers rotary force from the correction transfer lever to the correction lever, which is located in an axially different position. Therefore, when the pressing member presses the receiving section of the correction transfer lever, and the correction transfer lever and the correction lever pivot in the plane perpendicular to the axial direction to push the second display wheel, the correction transfer lever and the correction lever produce no axial moment even when the pressing member and the second display wheel differ from each other in terms of axial position. No action problem due to inclination of the correction transfer lever and the correction lever will therefore occur.

In the timepiece movement according to the aspect described above, it is preferable that the first driving wheel includes a first driving finger that engages the first display wheel, that the first driving wheel further includes a first elastic section deformed when a tooth of the first display wheel comes into contact with the first driving finger for correction of the first display wheel to avoid rotation of the first driving wheel, that the second driving wheel includes a second driving finger that engages with the second display wheel, and that the second driving wheel further includes a second elastic section deformed when a tooth of the second display wheel comes into contact with the second driving finger for correction of the second display wheel to avoid rotation of the second driving wheel.

According to the aspect described above, since the first elastic section and the second elastic section are provided, when the first display wheel and the second display wheel undergo correction and come into contact with the first driving finger and the second driving finger, the first elastic section and the second elastic section are elastically deformed to prevent the force produced by the contact being transmitted to the first driving wheel and the second driving wheel. Breakage of the first driving wheel and the second driving wheel due to the correction can therefore be avoided.

It is preferable that the timepiece movement according to the aspect described above further includes a second main plate having recesses and protrusions to which a member is attached, the second main plate attached to a front surface of a main plate of the movement. According to the aspect described above, providing the second main plate to which a new member can be attached allows expansion of the function of the timepiece movement.

According to the aspect described above, since the second main plate having recesses and protrusions for guiding or attaching a member is provided, a wide variety of members can be readily attached as compared with a typical pressing member with no change of the main plate, whereby a variety of additional functions can be added.

In the timepiece movement according to the aspect described above, it is preferable that the first display is date display, that the first display wheel is a date indicator, that the first driving wheel is a date indicator driving wheel, that the second display is lunar age display, that the second display wheel is a lunar age indicator, and that the second driving wheel is a lunar age indicator driving wheel.

According to the aspect described above, since the first display wheel is the date indicator and the second display wheel is the lunar age indicator, date display and lunar age display can be added as the additional functions to the timepiece, whereby the added value of the timepiece can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
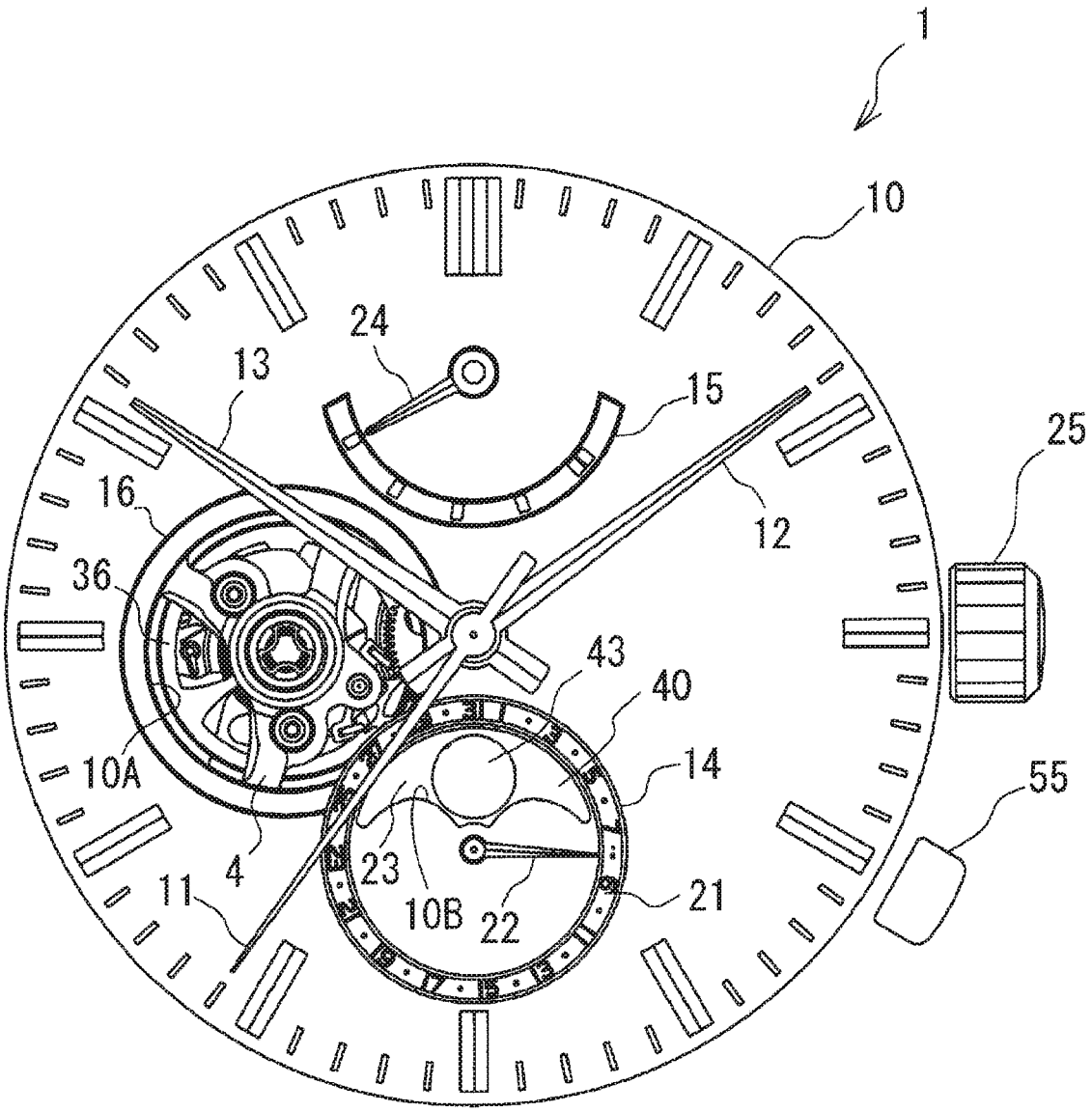
FIG. 1 is a plan view of a display section of a timepiece in which a movement according to an embodiment of the invention is used.

FIG. 1 shows a schematic configuration of a timepiece 1 provided with a movement 2 according to a first embodiment of the invention. Although not shown in FIG. 1, timepiece 1 includes an exterior case, a cover glass plate, and a case back. The cover glass plate is so attached to the exterior case as to cover a disc-shaped dial 10. In the timepiece 1, the dial 10 is provided as a display section that presents information to a user.

The dial 10 is provided with a second hand 11, a minute hand 12, and an hour hand 13 as indicating hands. The dial 10 is further provided with a small window 14, which is provided in a 6-o'clock position and displays the date and lunar age, a power-reserve small window 15, which is provided in a 12-o'clock position and includes a power reserve hand 24, which displays the remaining wound quantity of a movement barrel 76, which will be described later, and a partial skeleton section 16, which is provided in a 9-o'clock position.

In a plan view in which the dial 10 is viewed in the direction of an indicating hand shaft, as shown in FIG. 1, the partial skeleton section 16 is so configured that a balance with a hairspring 36, which serves as a drive member disposed on the rear surface side (rear side) of a main plate 4, is visible from above through an opening 10A of the dial 10.

In the small window 14, a date indicating hand 22 is an indicating hand for indicating the date and indicates any of the numerals from 1 to 31 displayed as markings 21 (in the present embodiment, only odd numbers are displayed in the form of numerals, and even numbers are each displayed in the form of a dot) for the date display as first display. A lunar age display section 23 performs lunar age display as second display by rotating a lunar age indicator 40 having a moon mark 43, which is visible through an opening 10B of the dial 10 and behaves as if the moon waxes and wanes.

Figure 2:
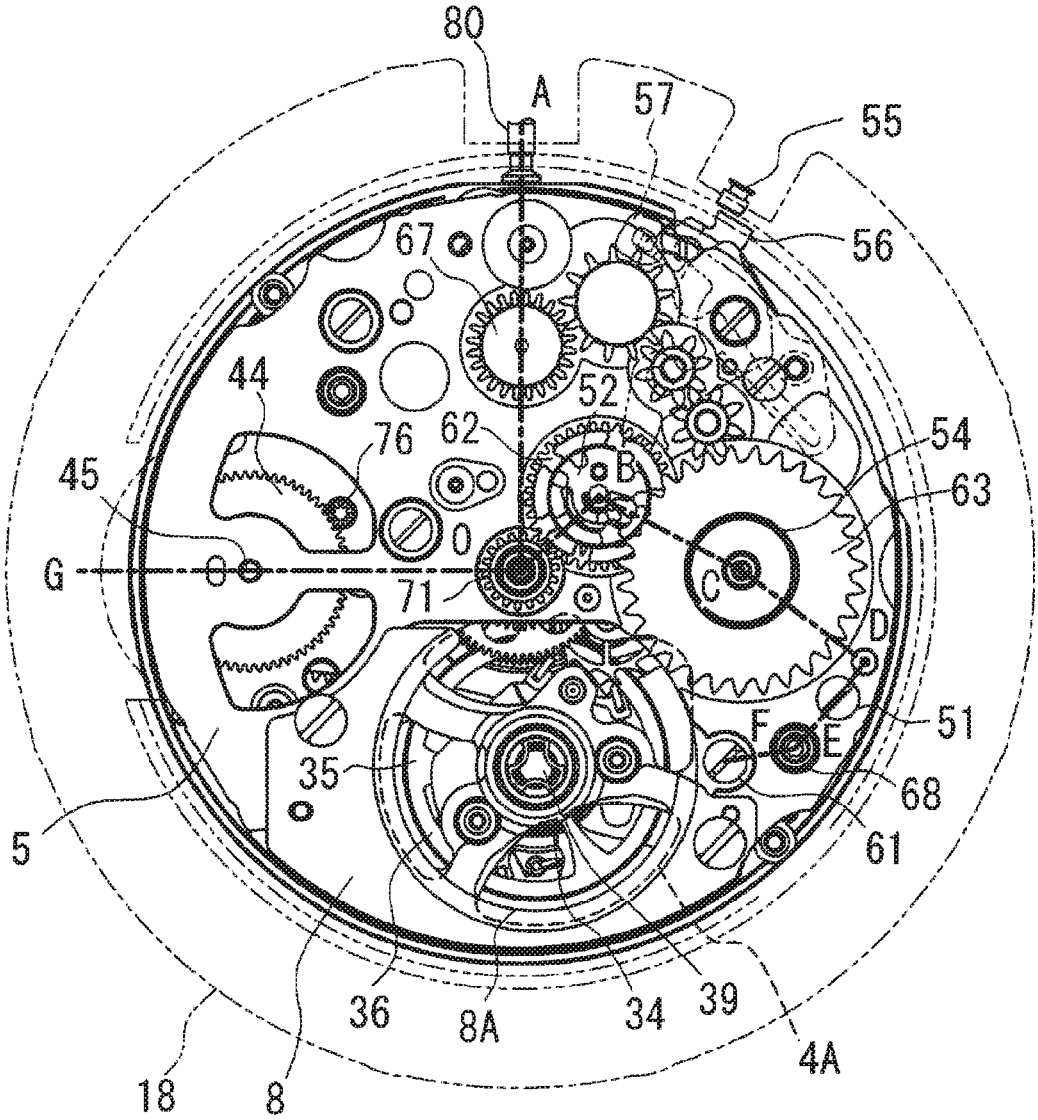
FIG. 2 is a plan view in a state in which a lunar age jumper and a date jumper are removed from the timepiece movement according to the embodiment of the invention.

Further, a button 55, which is used to correct the lunar age, and a crown 25 are attached to 4-o'clock and 3-o'clock positions of the exterior case, which is not shown, of the timepiece 1, respectively. The time, the date, and other pieces of information are corrected by operating the crown 25. In the present application, the front surface side of the timepiece 1 is the side facing the dial 10, which is the display section where the user visually recognizes information, and to indicate the orientation of a part that forms the timepiece, the front surface side is called an upper surface side in some cases. The rear surface side means the side opposite the front surface side. The plan view means that the front surface of the dial 10 is viewed in the direction perpendicular to the front surface. An axial direction means the direction of a straight line parallel to the axis of rotation of an hour wheel and other geared wheels. The button 55 shown in FIG. 1 is so drawn that the position thereof is clearly indicated for the convenience of description, and the specific shape of the button 55 is shown in FIG. 2. A movement contact portion of the button 55 (portion that forms a button mechanism and receives external contact, outermost portion of button 55) is so provided in a position recessed from the exterior case, which is not shown, as not to be operated by mistake, and the movement contact portion can be formed of a pillow-head button pressed with an elongated member, such as a ball-point pen.

Figure 3:
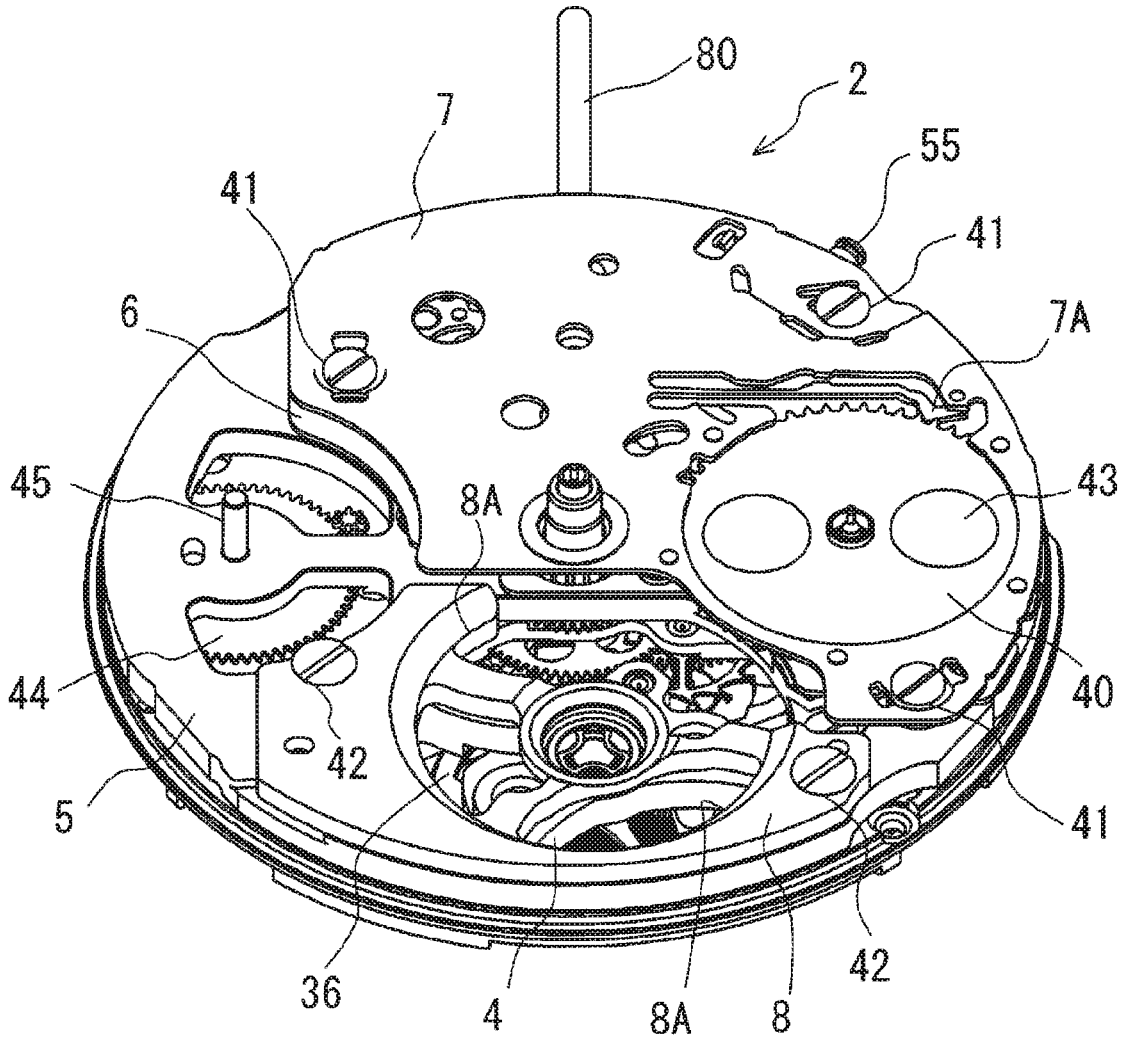
FIG. 3 is a perspective view showing the timepiece movement according to the embodiment.
Figure 4:
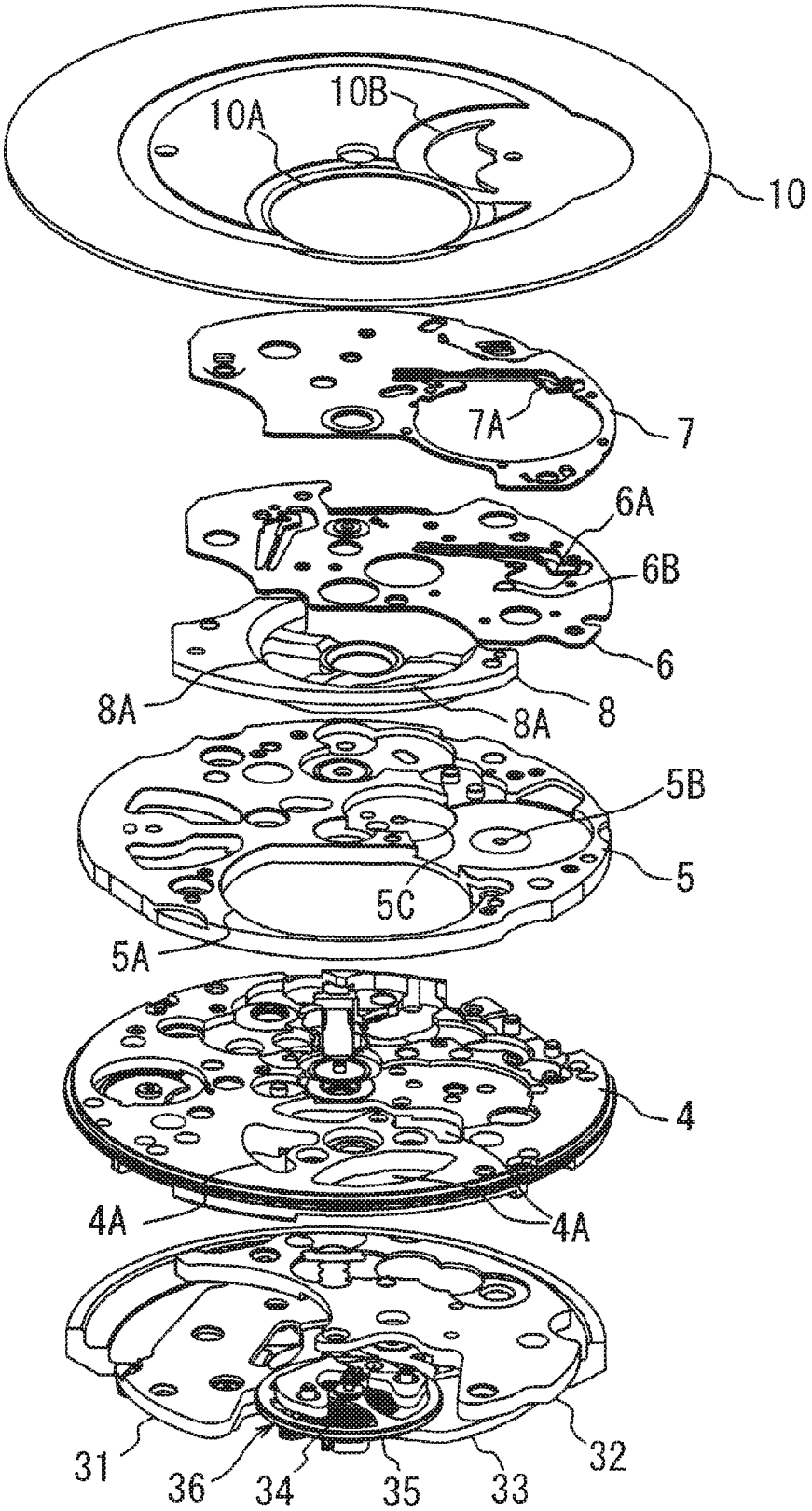
FIG. 4 is a perspective view showing the positional relationship among a main plate and other members that form the timepiece in the embodiment.
Figure 10:
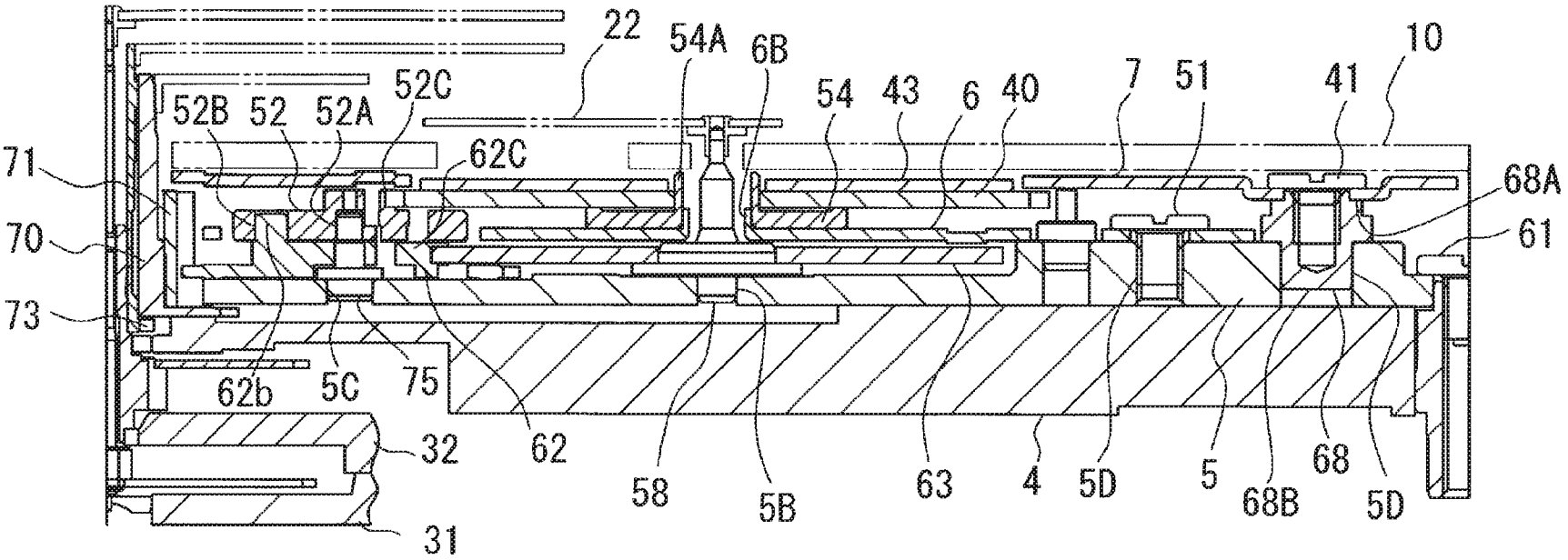
FIG. 10 is a cross-sectional view of the movement taken along the line O-B-C-D-E-F in FIG. 2.
Figure 11:
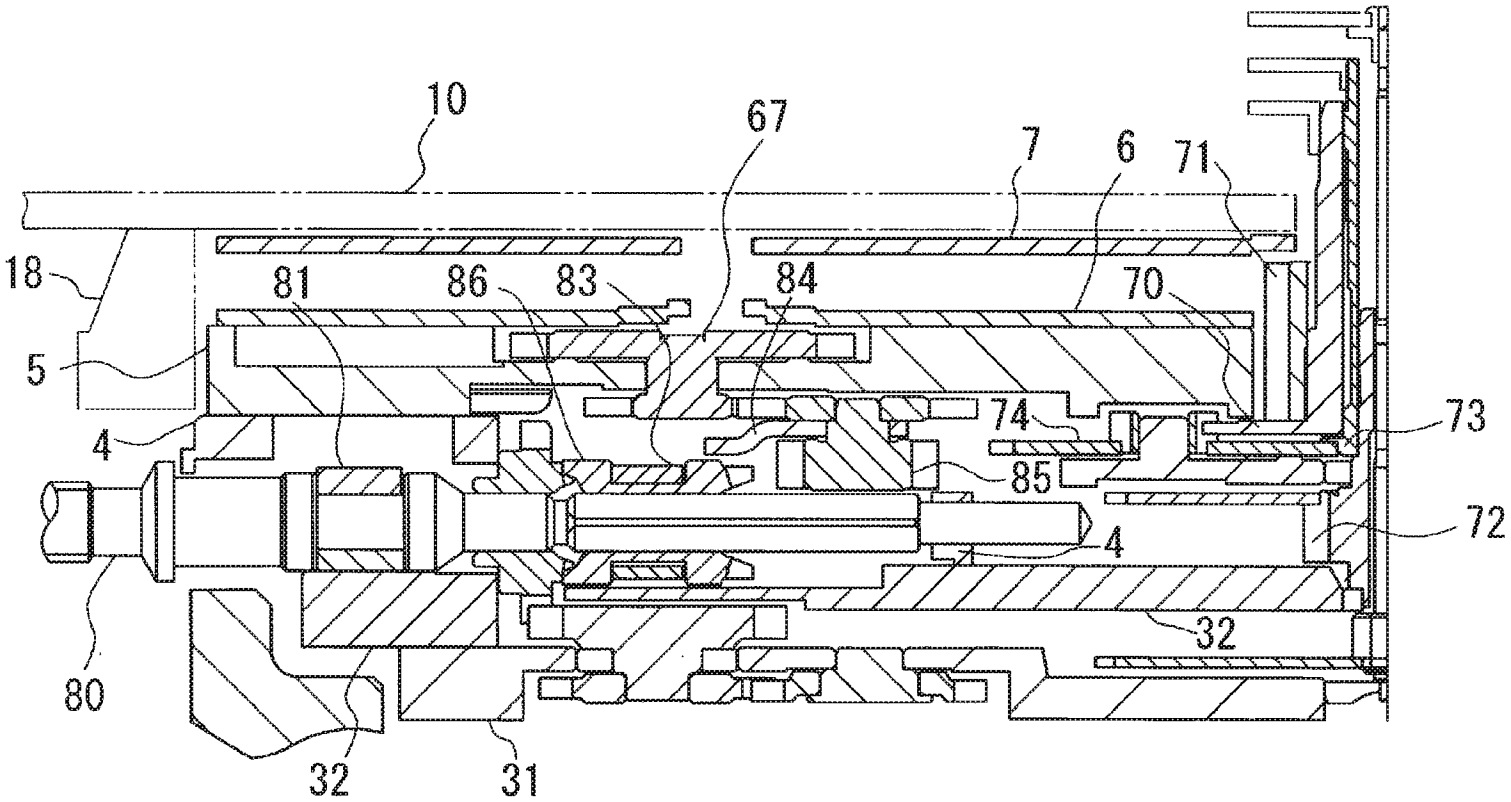
FIG. 11 is a cross-sectional view of the movement taken along the line O-A in FIG. 2.
Figure 12:
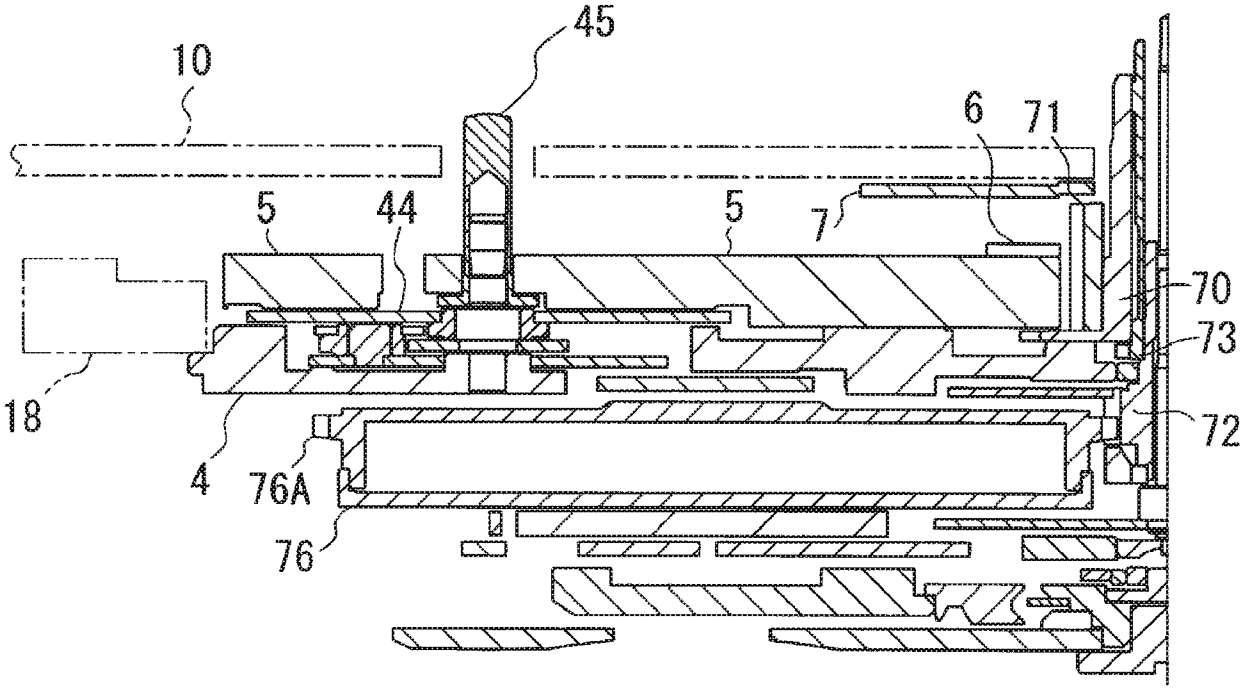
FIG. 12 is a cross-sectional view of the movement taken along the line O-G in FIG. 2.

FIG. 2 is a plan view of the movement 2 in a state in which a date jumper 6, which is a first pressing member, and a lunar age jumper 7, which is a second pressing member, are omitted. FIG. 3 is a perspective view of the movement 2 of the timepiece 1. FIG. 4 is a perspective view showing the positional relationship of the main plate 4 and other plate-shaped members with the dial 10 in the movement 2. In FIG. 2, the date jumper 6 and the lunar age jumper 7 are so omitted that the positions of a cutting line O-B-C-D-E-F and other cutting lines, whereas FIGS. 10 to 12 are cross-sectional views of the movement 2 in which the date jumper 6 and the lunar age jumper 7 are not omitted.

In the timepiece 1 in the present embodiment, a second main plate 5 is disposed on the side facing the upper surface (front surface) of the main plate 4 as the base frame, the date jumper 6 as the first pressing member and a cosmetic plate 8 as a decorative member are disposed on the second main plate 5, the lunar age jumper 7 as the second pressing member is further disposed above the date jumper 6, and the dial 10 is disposed above the lunar age jumper 7, as shown in FIG. 4.

Figure 5:
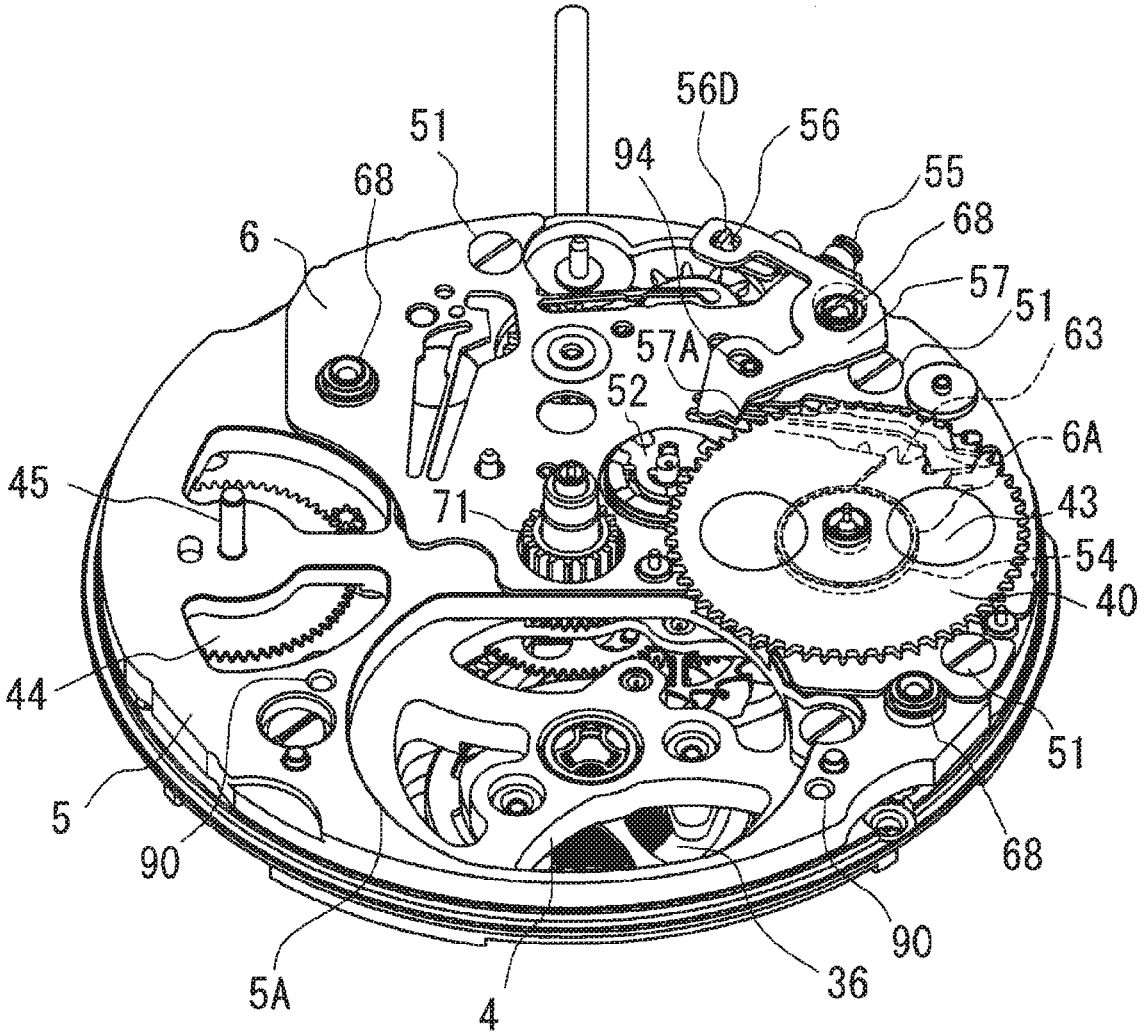
FIG. 5 is a perspective view of the movement with a cosmetic plate and a lunar age jumper removed.

The movement 2 includes an intermediate date wheel 71 and a date indicator 63 as a first display wheel, as shown in FIG. 2, and further includes the lunar age indicator 40 as a second display wheel, as shown in FIG. 5. In FIG. 2, the movement 2 includes a power reserve display tube 45, to which the power reserve hand 24, which indicates the wound quantity of the movement barrel 76, is attached, and a power reserve transfer geared wheel 44, which is a component of a power reserve display mechanism. The movement 2 further includes the cosmetic plate 8, which serves as a decorative member and is located on the side facing the upper surface of the second main plate 5, and the date jumper 6 as the first pressing member and the lunar age jumper 7 as the second pressing member are provided in areas separate from the cosmetic plate 8 in the top view, as shown in FIG. 3. The movement 2 further includes the main plate 4, which serves as the base frame of the movement 2, on the side facing the rear surface of the second main plate 5, and the balance with a hairspring 36 on the side facing the rear surface of the main plate 4, as shown in FIG. 4. The intermediate date wheel 71 in FIG. 2 rotates integrally with an hour wheel 70 shown in FIG. 8. The hour wheel 70, to which the hour hand 13 is attached, makes one revolution in 12 hours.

Date Indicator

Figure 7:
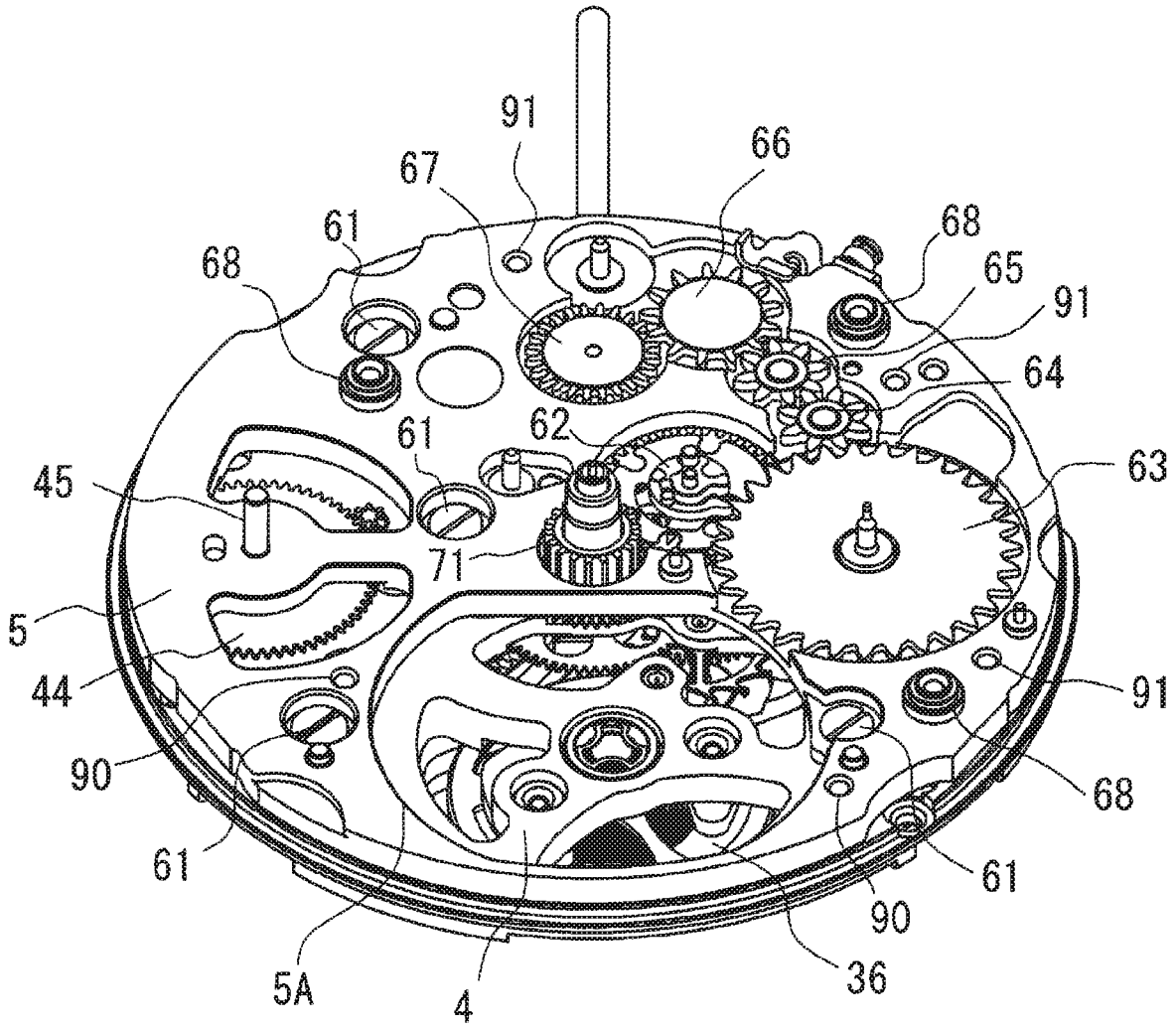
FIG. 7 is a perspective view of the movement with the date jumper removed from the state shown in FIG. 5.

The date indicator 63 will be described. FIG. 7 is a perspective view showing the state in which the date jumper 6 and the lunar age jumper 7 are removed from the movement 2. FIG. 10 is a cross-sectional view of the movement 2 taken along the cutting line O-B-C-D-E-F in FIG. 2. The second main plate 5 positions the date indicator 63 and a date indicator driving wheel 62. The date indicator 63 is positioned in the plane direction and the axial direction thereof when the shaft of the date indicator 63 is inserted into a guide hole 5B provided in the second main plate 5 so that the date indicator 63 is rotatably attached to the second main plate 5. The date indicator 63 is positioned in the axial direction by the date jumper 6 pressed from above. The date indicator driving wheel 62 is positioned in the plane direction and the axial direction thereof when so attached as to be rotatable around a center shaft 75 supported by the second main plate 5.

Figure 6:
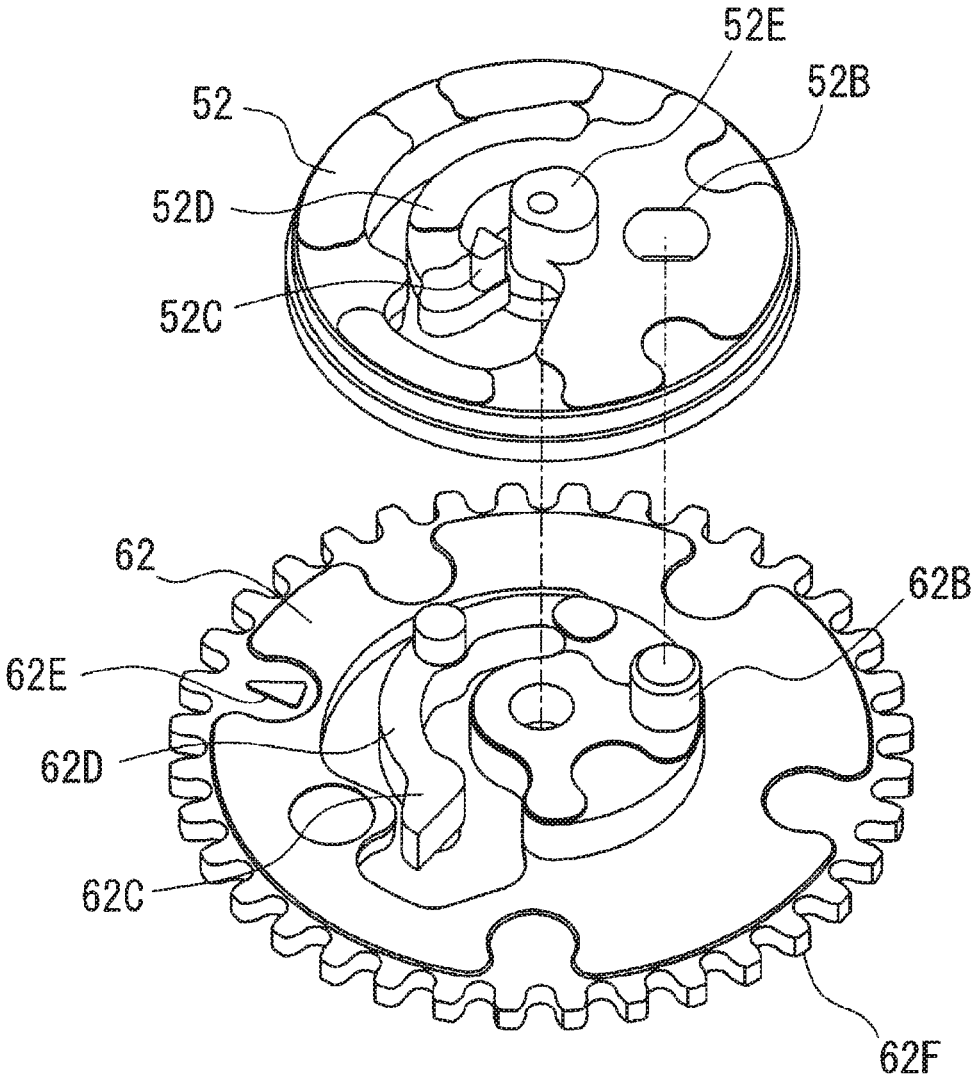
FIG. 6 is a perspective view showing a date indicator driving wheel and a lunar age indicator driving wheel.

The teeth of the date indicator driving wheel 62 engage with the teeth of the intermediate date wheel 71, and the date indicator driving wheel 62 is so configured as to make one revolution when the intermediate date wheel 71 makes two revolutions per day. The date indicator driving wheel 62 includes a date finger 62C, as shown in FIG. 6, and the date finger 62C engages with a tooth of the date indicator 63 to rotate the date indicator 63 by the amount corresponding to one tooth per day. The date indicating hand 22 attached to the shaft of the date indicator 63 can therefore advance by one marking per day. The date jumper 6 includes a jumper section 6A, which engages with a tooth of the date indicator 63 to determine the rotary direction of the date indicator 63 and allow intermittent rotation of the date indicator 63 once a day, as shown in FIGS. 4 and 5.

Lunar Age Indicator

The lunar age indicator 40 will be described. In FIG. 10, the movement 2 includes the lunar age indicator 40, a lunar age indicator guide seating 54, and a lunar age indicator driving wheel 52. The lunar age indicator guide seating 54 as a second display wheel guide seating is positioned by a tubular section 6B, which is formed as a guide section and so formed as to be part of the date jumper 6 and coaxial with the date indicator 63. The lunar age indicator 40 is slidably and rotatably positioned around the outer side of a rising section 54A of the lunar age indicator guide seating 54. The lunar age indicator 40 is axially positioned by the lunar age indicator guide seating 54 and the lunar age jumper 7. A shaft 58 of the date indicator 63 passes through the tubular section 6B of the date jumper 6 and the rising section 54A of the lunar age indicator guide seating 54 and is therefore so attached thereto that the date indicator 63 is coaxial with the lunar age indicator guide seating 54 and the lunar age indicator 40. The configuration described above allows the date indicator 63 and the lunar age indicator 40 to be disposed with an axial gap therebetween so that they are pivotable independently of each other. Further, the configuration in which the date indicator 63 and the lunar age indicator 40 are coaxial with each other allows the lunar age indicator 40 and the date indicating hand 22 to be coaxial with each other and further allows the moon mark 43, the opening 10B, the date indicating hand 22, and other components to be disposed in axially different positions in the small window 14 shown in FIG. 1 described above, whereby three-dimensional display having a depth is achieved and a highly decorative timepiece is therefore achieved.

Lunar Age Indicator Driving Wheel and Date Indicator Driving Wheel

The lunar age indicator driving wheel 52 is disposed above the date indicator driving wheel 62, positioned by the center shaft 75, which is supported by a guide hole 5C in the second main plate 5 and serves as the axis of rotation common to the axis of rotation of the date indicator driving wheel 62, as shown in FIG. 10, and attached by inserting a dowel 62B of the date indicator driving wheel 62 into a dowel receiving hole 52B, as shown in FIG. 6. The lunar age indicator driving wheel 52 is thus rotatably so attached as to be coaxial with the date indicator driving wheel 62.

Since the lunar age indicator driving wheel 52 is rotatable along with the date indicator driving wheel 62, and the dowel 62B and the dowel receiving hole 52B determine the relative positional relationship in the rotary direction between the lunar age indicator driving wheel 52 and the date indicator driving wheel 62, an assembly worker does not need to consider the difference in phase between the lunar age indicator driving wheel 52 and the date indicator driving wheel 62 (difference in rotary position) and can therefore assemble the lunar age indicator driving wheel 52 and the date indicator driving wheel 62 without considering the difference in phase between the forwarded position of the date indicator 63 and the forwarded position of the lunar age indicator 40. In related art, in a hand attaching step in the assembly process, the period after the date hand is switched but until the lunar age indicator and other display wheels are switched (forwarding period) needs to be checked. In the present embodiment, however, since the configuration described above fixes the different in phase between the lunar age indicator driving wheel 52 and the date indicator driving wheel 62, the work of checking the period required to forward the display wheels is not required, whereby the manufacturing efficiency can be improved.

Further, the position of one of the dowel 62B of the date indicator driving wheel 62 and the dowel receiving hole 52B of the lunar age indicator driving wheel 52 can be changed to change the difference in phase between the lunar age indicator driving wheel 52 and the date indicator driving wheel 62, whereby the forwarded positions of the date indicator 63 and the lunar age indicator 40 in the forwarding direction can be adjusted. That is, the timing when the date hand is switched and the timing when the lunar age is switched can be readily adjusted by changing the positions of the dowel 62B and the dowel receiving hole 52B. Further, in the present embodiment, the switching of the date hand and the switching of the lunar age are so adjusted that they are switched at the same timing. The date indicator driving wheel 62 and the lunar age indicator driving wheel 52 are both axially positioned with play (gap) therebetween by the second main plate 5 and the lunar age jumper 7.

The date indicator driving wheel 62, a tooth shape section 62F of which engages with the intermediate date wheel 71, transfers rotary force via the dowel 62B to the lunar age indicator driving wheel 52, and the lunar age indicator driving wheel 52 makes one revolution when the intermediate date wheel 71 makes two revolutions per day. The lunar age indicator driving wheel 52 includes a lunar age finger 52C, as shown in FIG. 6, and the lunar age finger 52C engages with a tooth of the lunar age indicator 40 to rotate the lunar age indicator 40 by the amount corresponding to one tooth per day, whereby the moon mark 43 can rotate and advance by the amount corresponding to one day. Since one cycle of the lunar age is about 29.5 days, the lunar age indicator 40 has two moon marks 43 separate by 180 degrees, as shown in FIG. 3, and makes one revolution in 59 days, which correspond to two cycles of the lunar age. The lunar age jumper 7 is provided with a jumper section 7A, which engages with a tooth of the lunar age indicator 40 to determine the rotary direction position of the lunar age indicator 40 and allow intermittent rotation of the lunar age indicator 40 once a day. The date indicator driving wheel 62 includes the tooth shape section 62F, which engages with the intermediate date wheel 71, but the lunar age indicator driving wheel 52 includes no tooth shape section, as shown in FIG. 6. No tooth shape section is required because the lunar age indicator driving wheel 52 is rotated by the rotary force transmitted from the date indicator driving wheel 62 via the dowel 62B. The configuration described above eliminates the need for engagement between the lunar age indicator driving wheel 52 and the intermediate date wheel 71, and no need to provide an engagement section allows decrease in the thickness of the lunar age indicator driving wheel 52. The decrease in the thickness the lunar age indicator driving wheel 52 contributes to decrease in the thickness of the movement 2. In the present embodiment, the date indicator driving wheel 62 is provided with the tooth shape section 62F, the date indicator driving wheel 62 or the lunar age indicator driving wheel 52 only needs to be provided with the tooth shape section. For example, only the lunar age indicator driving wheel 52 may be provided with the tooth shape section, and the tooth shape section of the lunar age indicator driving wheel 52 may engage with the intermediate date wheel 71. In the present embodiment, the tooth shape section 62F engages with the intermediate date wheel 71 as another geared wheel. Instead, the tooth shape section 62F may engage with another geared wheel in the time display train wheels for transmission of the rotary force.

Main Plate, Second Main Plate, Jumpers, and the Like

Figure 8:
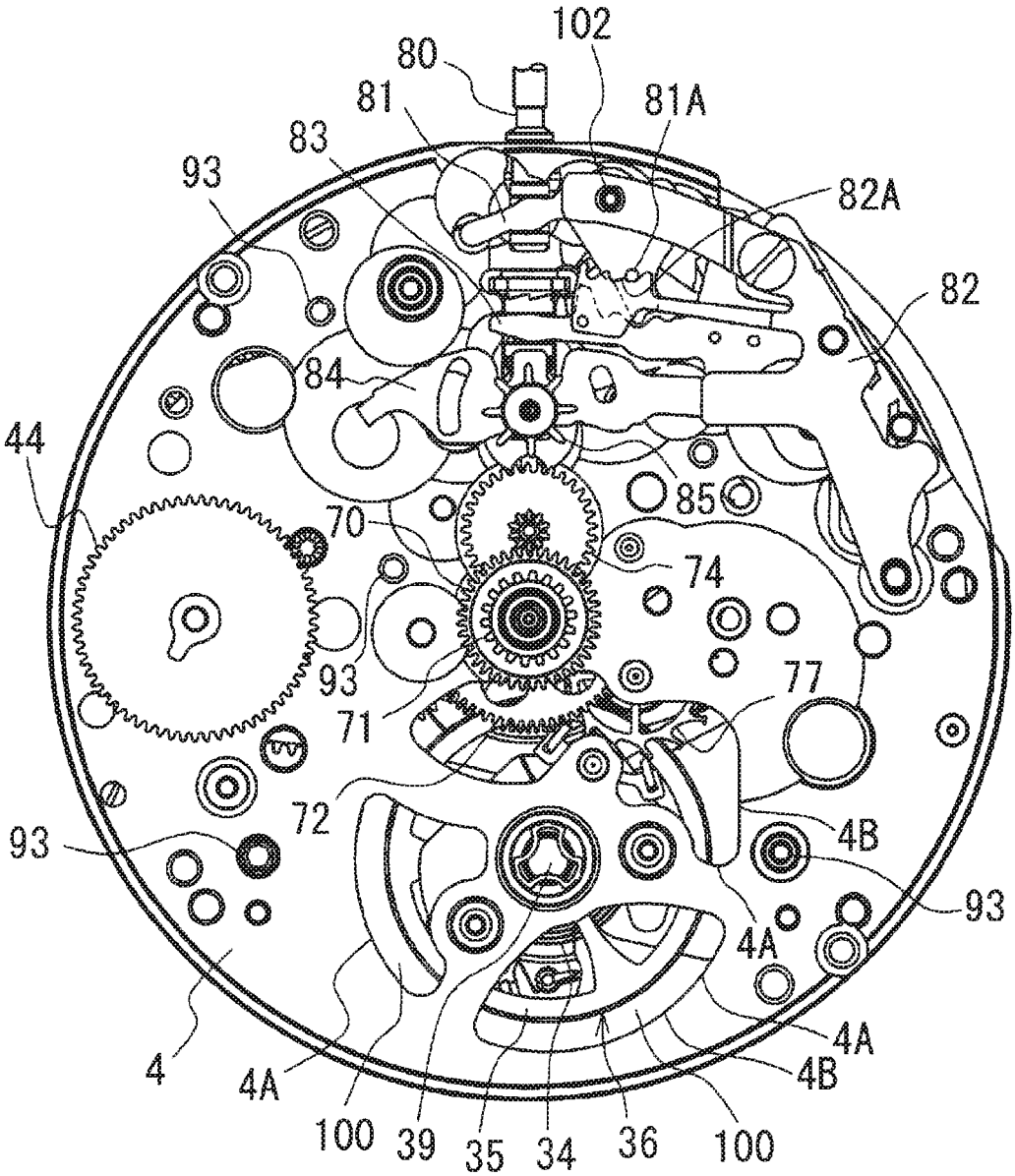
FIG. 8 is a plan view of the movement in which a second main plate is removed from the state shown in FIG. 7.

The structure for fixing the main plate 4, the second main plate 5, the date jumper 6, and other members to one another will be described. FIG. 7 is a perspective view in a state in which the date jumper 6, the lunar age jumper 7, and the cosmetic plate 8 are removed from the movement 2. FIG. 8 is a plan view in a state in which the second main plate 5 is removed from the movement 2. The second main plate 5 is fixed to the main plate 4 by inserting screws 61 in FIG. 7 through screw insertion holes (not shown) in the second main plate 5 and causing the screws 61 to engage with threaded holes 93. The threaded holes 93 may be directly formed in the second main plate 4 or may each be provided by attaching another member having a threaded hole to the second main plate. The threaded holes 93 not only may serve as the threaded holes for attaching the second main plate 5 but may be used as multipurpose threaded holes that allow, in a case where the second main plate 5 is not attached, a member of related art, such as a pressing plate other than the second main plate 5, to be attached to the timepiece. The multipurpose threaded holes 93 allow the specifications to be readily changed because it is not necessary to change the design of the main plate 4 irrespective of attachment or detachment of the second main plate 5.

FIG. 5 is a perspective view in a state in which the lunar age jumper 7 is removed from the movement 2. The date jumper 6 is fixed to the second main plate 5 by inserting screws 51 in FIG. 5 through screw insertion holes (not shown) in the date jumper 6 and causing the screws 51 to engage with threaded holes 91 provided in the second main plate 5 in FIG. 7.

The lunar age jumper 7 is attached to the movement 2 by using screws 41 in FIG. 3 and screw receiving members 68 in FIG. 5. The screw receiving members 68 are each fixed to the second main plate 5 by fitting a lower section 68B of the screw receiving member 68 into a screw receiving hole 5D provided in the second main plate 5 in a press fitting process, as shown in FIG. 10. The lunar age jumper 7 is then axially positioned by a stepped section 68A, which is an upper portion of each of the screw receiving members 68, and the screws 41 and fixed to the screw receiving members 68 with the screws 41. The screw receiving members 68 are attached at three locations, as shown in FIG. 5, in addition to the location shown in the cross-sectional view of FIG. 10, and through holes or cutouts are so provided in the date jumper 6 that the screw receiving members 68 can be attached to the lunar age jumper 7.

The cosmetic plate 8 is fixed to the second main plate 5 by inserting screws 42 in FIG. 3 through screw insertion holes (not shown) in the cosmetic plate 8 and causing the screws 42 to engage with threaded holes 90 in the second main plate 5 in FIG. 5. A dial receiving ring 18 (see FIG. 2) is attached to the main plate 4, and the dial 10 is disposed on the side facing the upper surface of the dial receiving ring 18, as shown in FIG. 12. An exterior case that is not shown is attached to the dial receiving ring 18 and the dial 10.

In FIG. 7, the date indicator 63, which is the first display wheel, date corrector setting wheels 64 and 65, which form corrector train wheels of the date indicator 63, a calendar corrector wheel 66, and a second calendar corrector wheel 67 are provided on the second main plate 5. These geared wheels are axially positioned by the date jumper 6 and the second main plate 5. The second main plate 5 serves to guide the date indicator 63 and positioning rotary shafts of the corrector train wheels of the date indicator 63. The second main plate 5 only needs to have recesses and protrusions for guiding and attaching the geared wheels and other members, as does the main plate 4, which functions as the base frame, and members and train wheels different from those in the present embodiment may be attached to the second main plate 5. Providing the second main plate 5 allows addition of a function, such as a display function, to the timepiece 1 by adding or changing the second main plate 5 without changing the design of the main plate 4, relatively readily allowing improvement in added value of the timepiece 1 in a variety of manners. Further, the same parts as those attached to the main plate 4 can be attached to the second main plate 5, which means that a wider variety of parts can be attached to the second main plate 5 than to a typical pressing plate. In the present embodiment, the second main plate 5 is made of a metallic material, and threaded holes are provided in the second main plate 5, which is made of a metallic material, but the second main plate 5 is not necessarily made of a metallic material. For example, the second main plate may be made of a resin material, the second main plate made of a resin material may be provided with separate member attachment holes, and separate members each having a threaded hole may be inserted into the attachment holes.

Lunar Age Correction Mechanism

Figure 13:
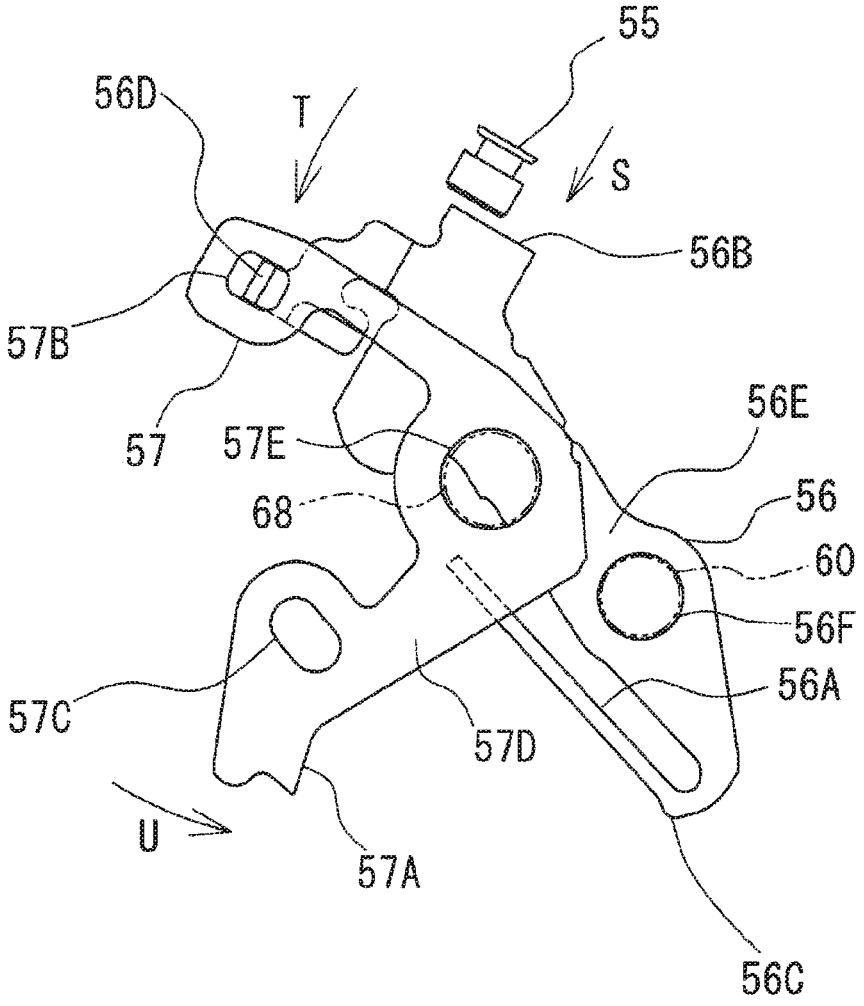
FIG. 13 shows a lunar age correction transfer lever, a lunar age correction lever, and a button extracted from the movement that form a lunar age correction mechanism.
Figure 14:
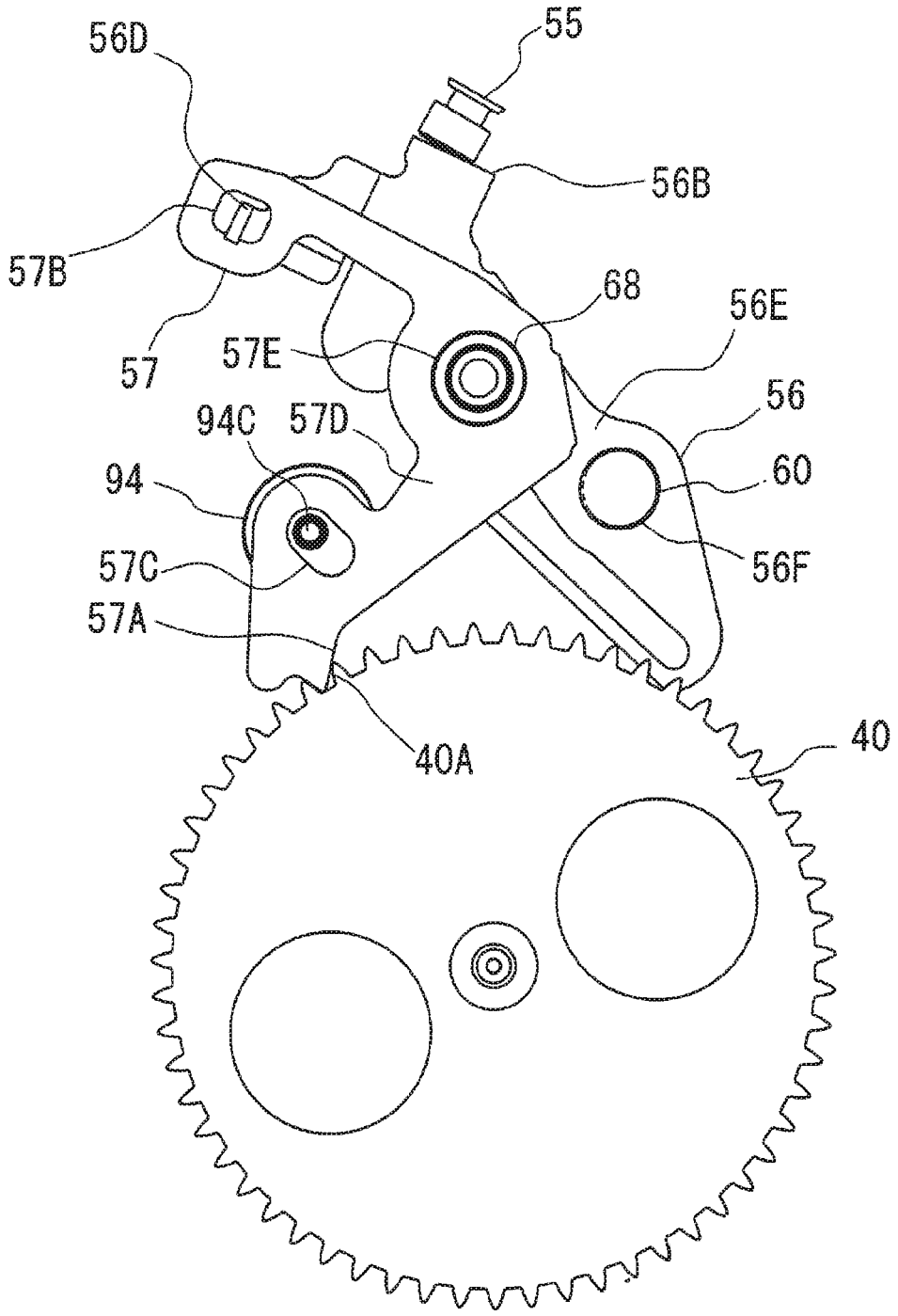
FIG. 14 shows the lunar age correction transfer lever, the lunar age correction lever, and a lunar age indicator in a state in which the button is pressed.

The lunar age correction mechanism will be described. FIG. 5 is a perspective view of the movement 2 in the state in which the cosmetic plate 8 and the lunar age jumper 7 are removed, as described above, and FIG. 9 is a bottom view of the second main plate 5 viewed from the side facing the rear surface thereof. FIG. 13 shows a lunar age correction transfer lever 56, a lunar age correction lever 57, and the button 55 extracted from the movement 2, which form the lunar age correction mechanism. FIG. 14 shows the lunar age correction transfer lever 56, the lunar age correction lever 57, and the lunar age indicator 40 in a state in which the button 55 is pressed.

Figure 15:
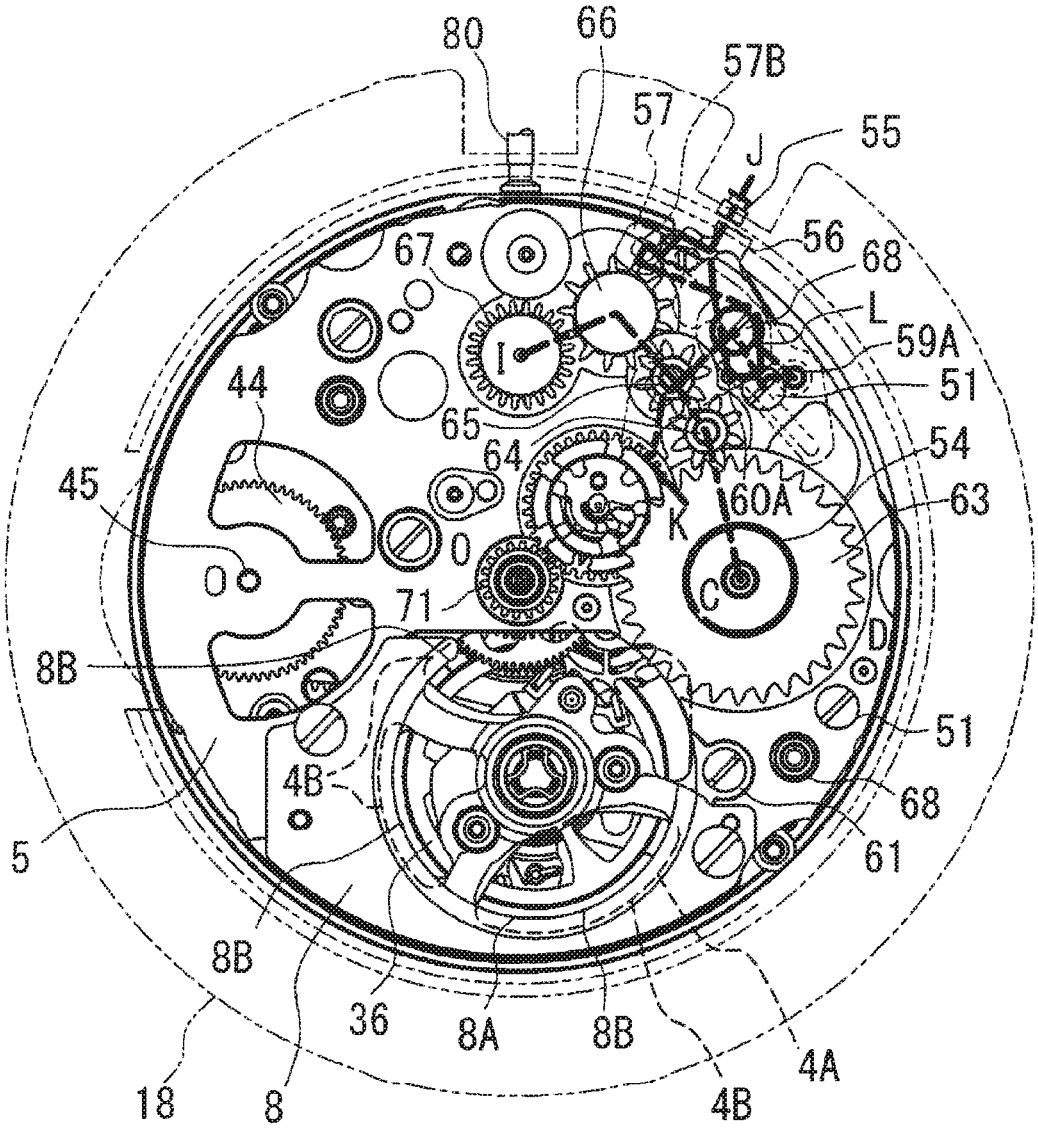
FIG. 15 is a plan view in the state in which the lunar age jumper and the date jumper are removed from the timepiece movement according to the embodiment.
Figure 16:
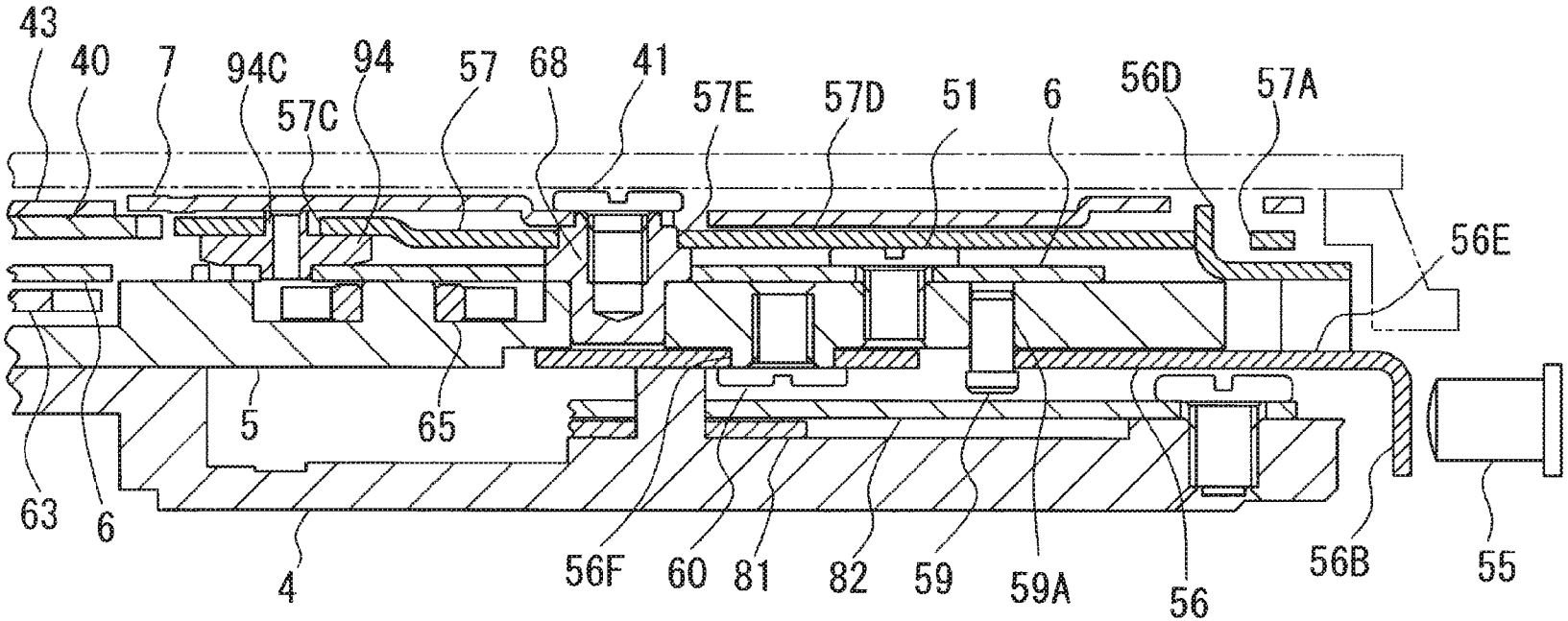
FIG. 16 is a cross-sectional view formed of a cross-sectional view shown on the side facing the front surface of the second main plate and showing the movement taken along a cutting line J-K in FIG. 15 and a cross-sectional view shown on the side facing the rear surface of the second main plate and showing the movement taken along a cutting line J-L in FIG. 15.
Figure 17:
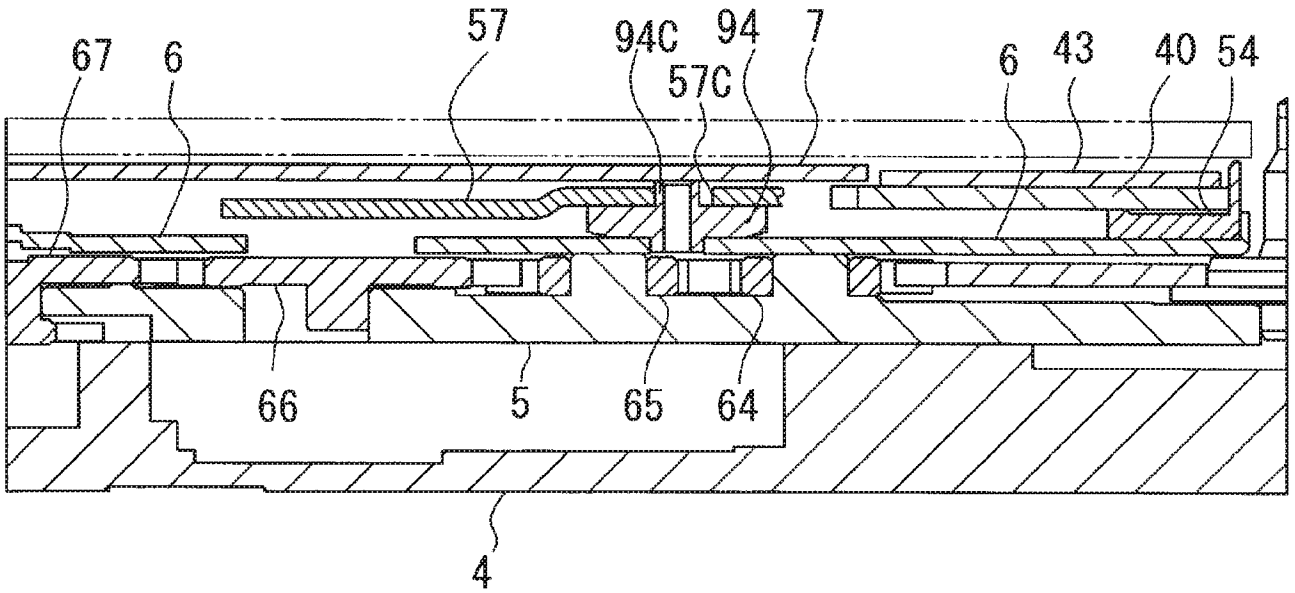
FIG. 17 is a cross-sectional view of the movement taken along a cutting line I-C in FIG. 15.

FIG. 15 shows the movement 2 in a state in which the date jumper 6 is removed and which is similar to the state in FIG. 2 and shows cutting lines J-K, J-L, and I-C. The cutting line J-K passes through the button 55, a reception hole 57B of the lunar age correction lever 57, one of the screws 51, one of the screw receiving members 68 (screw 41), the date corrector setting wheel 65, and a corrector lever seating 94 (see FIGS. 5 and 14), as shown in FIG. 15. The cutting line J-L passes through a pin 59 (see FIG. 9) and a screw 60 (see FIG. 9). The cutting line I-C passes through the second calendar corrector wheel 67, the calendar corrector wheel 66, the date corrector setting wheels 64 and 65, and the date indicator 63. FIG. 16 is a cross-sectional view taken along two cutting lines: The cross-sectional view on the side facing the front surface of the second main plate 5 is a cross-sectional view of the movement 2 taken along the cutting line J-K in FIG. 15; and the cross-sectional view on the side facing the rear surface of the second main plate 5 is a cross-sectional view of the movement 2 taken along the cutting line J-L in FIG. 15. FIG. 17 is a cross-sectional view of the movement 2 taken along the cutting line I-C in FIG. 15.

The lunar age correction mechanism includes the lunar age correction transfer lever 56, which transfers force by which the button 55 as a pressing member is pressed, and the lunar age correction lever 57, which serves as a correction lever that engages and synchronizes with the lunar age correction transfer lever 56 to cause the lunar age indicator 40 to pivot.

Figure 9:
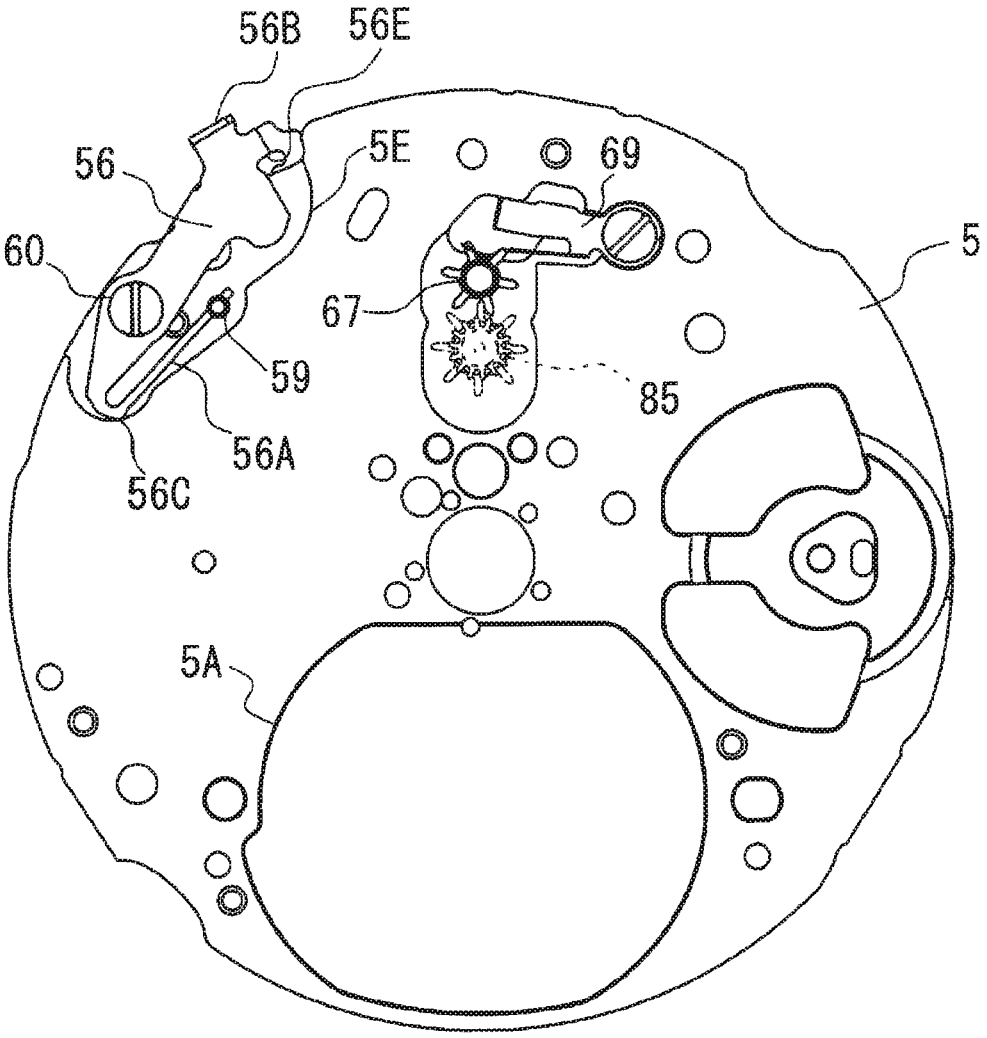
FIG. 9 is a bottom view of the second main plate viewed from the rear side thereof.

The lunar age correction transfer lever 56 includes a transfer lever main plate section 56E, which is so provided as to be parallel to a plane perpendicular to the axial direction, an elastic section 56A, which produces elastic force, a reception section 56B, which comes into contact with the button 55 when the button is pressed, and an engagement section 56D, which engages with the lunar age correction lever 57. The lunar age correction transfer lever 56 is so attached to a recess 5E, which is located on the rear surface side of the second main plate 5 and provided to incorporate the lunar age correction transfer lever 56, as to be pivotable around a screw 60 as a first fixing member, as shown in FIG. 9. The elastic section 56A of the lunar age correction transfer lever 56 is bent by the pin 59 toward the screw 60. In FIG. 9, the elastic force produced by the elastic section 56A produces counterclockwise rotary force, and a degree determining section 56C comes into contact with the second main plate 5 for in-plane positioning.

The lunar age correction lever 57 includes a correction lever main plate section 57D, which is so provided as to be parallel to a plane perpendicular to the axial direction, a reception hole 57B, which engages with the engagement section 56D of the lunar age correction transfer lever 56, a correction section 57A, which comes into contact with a tooth of the lunar age indicator 40, and an insertion hole 57C, which will be described later. The screw receiving members 68 that is located in the vicinity of the lunar age correction lever 57 and serves as a second fixing member is so configured that the lunar age correction lever 57 comes into contact with a stepped portion of the screw receiving member 68 and the stepped portion serves as the shaft of rotation of the lunar age correction lever 57, and the lunar age correction lever 57 is axially positioned by the stepped portion of the screw receiving member 68 and the lunar age jumper 7, as shown in FIG. 16. The corrector lever seating 94, which is guided by the date jumper 6, axially positions the lunar age correction lever 57, and a dowel 94C of the corrector lever seating 94 is inserted through the insertion hole 57C of the lunar age correction lever 57 to ensure axial play (gap) for action of the lunar age correction lever 57, as shown in FIGS. 16 and 17.

The structure that prevents inclination of the lunar age correction lever 57 and the lunar age correction transfer lever 56 will be described. The transfer lever main plate section 56E of the lunar age correction transfer lever 56, the insertion hole 56F of the screw 60, which is provided in the lever main plate section 56E and into which the screw 60, which serves as the center of rotation, is inserted, and the button 55 are disposed in roughly the same axial positions (upward/downward direction in FIG. 16), as shown in FIG. 16. Further, the correction lever main plate section 57D of the lunar age correction lever 57, the insertion hole 57E, which is provided in the correction lever main plate section 57D and into which the screw receiving member 68, which serves as the center of rotation, is inserted, the reception hole 57B, and the lunar age indicator 40 are disposed in roughly the same axial positions (upward/downward direction in FIG. 16). The engagement section 56D, which transfers the force produced by the lunar age correction lever 57 from the lunar age correction transfer lever 56, is so formed as to extend beyond the second main plate 5 toward the reception hole 57B of the lunar age correction lever 57. Since the transfer lever main plate section 56E of the lunar age correction transfer lever 56 and the insertion hole 56F, which is the center of rotation of the transfer lever main plate section 56E, are present in the same plane, the lunar age correction transfer lever 56 does not produce axial moment when the button 55 is pressed, whereby no inclination of the lunar age correction transfer lever 56 occurs. Further, since the correction lever main plate section 57D of the lunar age correction lever 57, the insertion hole 57E, which is the center of rotation of the correction lever main plate section 57D, the reception hole 57B, and the lunar age indicator 40 are present in roughly the same cross-section, the lunar age correction lever 57 does not produce axial moment when the button 55 is pressed. The engagement section 56D transfers the rotary force from the lunar age correction transfer lever 56 to the lunar age correction lever 57, which is located in a position axially different from the position of the lunar age correction transfer lever 56. The difference in axial position between the button 55 and the lunar age indicator 40 therefore does not causes them to produce axial moment when the button 55 is pressed. Inclination of the lunar age correction transfer lever 56 or the lunar age correction lever 57 therefore does not occur, whereby action problems, such as insufficient action due to inclination of any of the members, can be avoided.

The action of the lunar age correction mechanism will be described. When the user presses the button 55 in the direction indicated by the arrow S, the button 55 presses the reception section 56B, so that the rotary force is transmitted to the lunar age correction transfer level 56, which is then pivot in the direction indicated by the arrow T, as shown in FIG. 13. The engagement section 56D then engages with the reception hole 57B, and the lunar age correction lever 57 therefore pivots in the direction indicated by the arrow U. The lunar age correction lever 57 having pivoted in this direction, specifically, the correction section 57A in the vicinity of the front end of the lunar age correction lever 57 comes into contact with the geared lunar age indicator 40, whereby the lunar age indicator 40 rotates by the amount corresponding to one tooth, as shown in FIG. 14.

As described above, since the lunar age correction transfer level 56 and the lunar age correction lever 57 are provided as the lunar age correction mechanism, the display wheels for the date display and lunar age display (date indicator 63 and lunar age indicator 40) and the driving wheels therefor (date indicator driving wheel 62 and lunar age indicator driving wheel 52) can be coaxially and simultaneously rotated, and a correction value of the lunar age can be independently inputted with no synchronization with the date display.

When the user stops pressing the button 55, a return spring (not shown) formed in the button returns the button 55 to a specified position, and the force acting on the reception section 56B is therefore eliminated. Therefore, in FIG. 9, the counterclockwise rotary force produced by the elastic section 56A returns the lunar age correction transfer level 56 to the position determined by the degree determining section, and the lunar age correction lever 57, which synchronizes with the lunar age correction transfer lever 56, also returns to the usual position. The number of teeth of the lunar age indicator 40 involved in the lunar age correction is thus set in accordance with the number of pressing actions performed on the button 55. When the button 55 is pressed, the rotation of the lunar age correction transfer level 56 is restricted because the edge of the transfer lever main plate section 56E comes into contact with the second main plate 5, whereby no excessive force is transferred to the lunar age correction lever 57. Further, the configuration in which the number of teeth of the lunar age indicator involved in the lunar age correction is set in accordance with the number of pressing actions performed on the button 55 allows adjustment of the number of days to be advanced in response to the number of pressing actions performed on the button, whereby the user can readily perform the correction. For example, when the user acquires information on the number of days corresponding to the difference between the lunar age on the date to be corrected and the new moon or the full moon, the user can, at the time of the correction, temporarily set the position of the lunar age indicator 40 at the position of the new moon or the full moon and presses the button while counting the number corresponding to the number of days corresponding to the difference from the lunar age on the date to be corrected, whereby the user can reliably perform the correction with a small chance of mistake.

In the present embodiment, the two levers, the lunar age correction transfer lever 56 and the lunar age correction lever 57, are provided as the lunar age correction mechanism. The lunar age correction mechanism may instead be formed of one lever. That is, a lunar age correction lever may be pivotably provided, and the one lunar age correction lever may be provided with a reception section that receives the force from the button and a correction section that comes into contact with the lunar age indicator to form the lunar age correction mechanism.

Correction Mechanism in First Layer

A pinion of the second calendar corrector wheel 67 is disposed on the rear side of the second main plate 5, as shown in FIG. 9. A toothed portion of the pinion of the second calendar corrector wheel 67 engages with a jumper 69 to restrict the position of the toothed portion of the second calendar corrector wheel 67 so that the teeth ends of the second calendar corrector wheel 67 and the a calendar corrector transfer wheel are so positioned as not to come into contact with each other, as shown in FIG. 9, whereby the second calendar corrector wheel 67 and the calendar corrector transfer wheel, which rotates integrally with a setting wheel 85 in FIG. 11, do not thrust each other when they engage with each other. The second calendar corrector wheel 67 includes the pinion rotatably disposed on the rear side of the second main plate 5 and a gear rotatably disposed on the front side of the second main plate 5, as shown in FIG. 11. FIG. 9 shows an imaginary calendar corrector transfer wheel that rotates integrally with the setting wheel 85 and shows that the calendar corrector transfer wheel, which rotates integrally with the setting wheel 85, engages with the second calendar corrector wheel 67.

Figure 18:
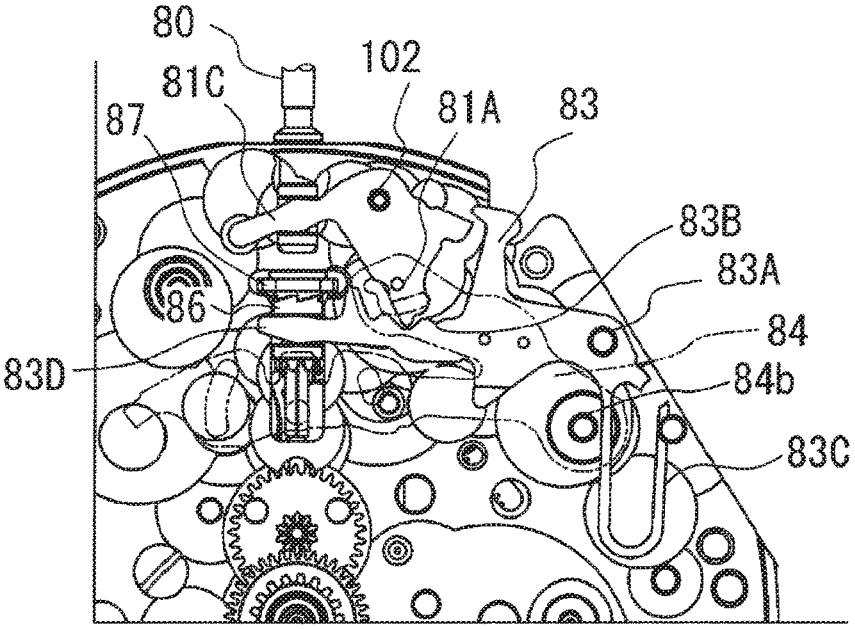
FIG. 18 shows the positional relationship between a setting lever and a yoke.
Figure 19:
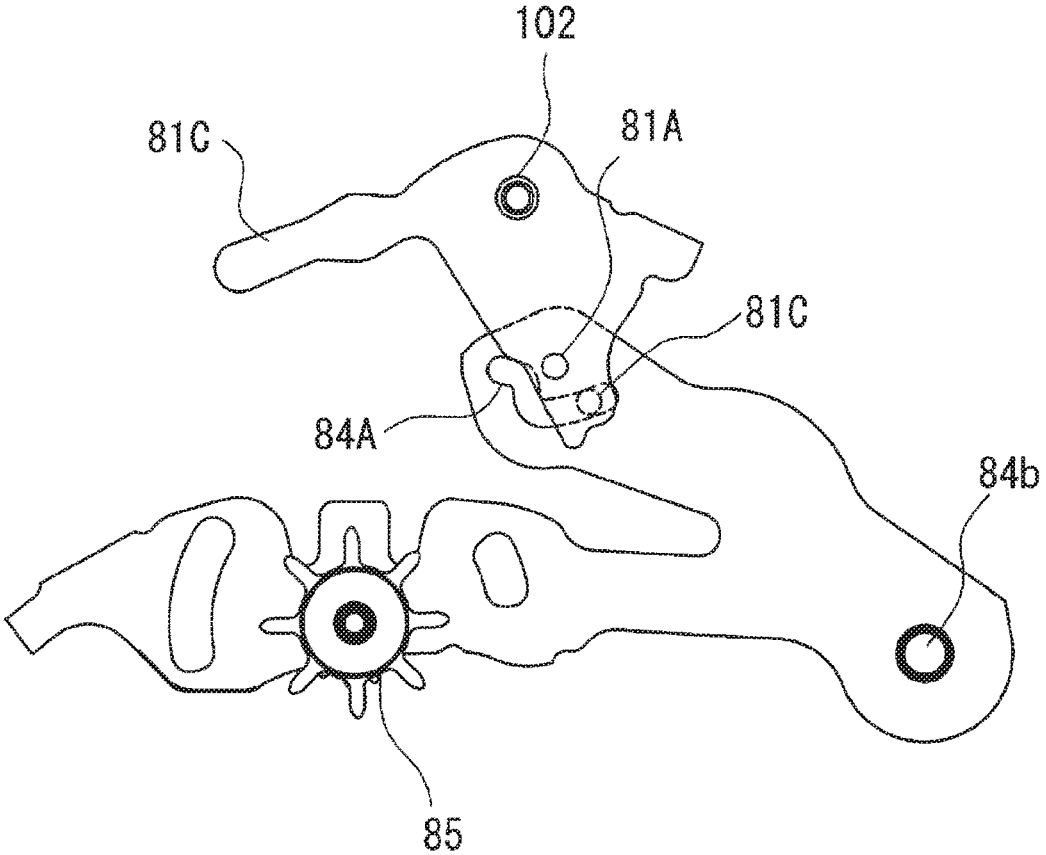
FIG. 19 shows the positional relationship between the setting lever and a setting wheel lever.

A setting lever 81, a setting wheel plate 82, a yoke 83, and a setting wheel lever 84 including the setting wheel 85 are provided in the layer (first layer) between the main plate 4 and the second main plate 5, as shown in FIGS. 8 and 11. FIG. 18 shows the positional relationship, around the setting lever 81, between the setting lever 81 and the yoke 83 with the setting wheel plate 82 and other components omitted. FIG. 19 shows the setting lever 81 and the setting wheel lever 84.

The setting lever 81 includes a setting lever operating section 81C, which engages with a winding stem 80, and when the winding step 80 is pulled by two steps, the setting lever 81 swings around a setting lever shaft 102, as shown in FIG. 8. As shown in FIG. 8, the configuration in which a setting lever restricting shaft 81A is in contact with a setting lever restricting section 82A of the setting wheel plate 82 causes the winding stem 80 to be pulled and moved, and the setting lever 81 swings around the setting lever shaft 102. In response to the swing motion, the setting lever restricting shaft 81A moves along the setting lever restricting section 82A. In this process, since the setting wheel plate 82 is elastically deformed, the user has a clicking sensation when pulling the winding stem 80.

The yoke 83 includes a yoke operating section 83B, a clutch wheel 86, which engages with The yoke operating section 83D, and an elastic section 83C, which urges the yoke 83 with spring force, as shown in FIG. 18, and the lower end of the setting lever 81 is in contact with the yoke operating section 83B of the yoke 83. When the winding stem 80 is pulled to cause the setting lever 81 to swing, the lower end of the setting lever 81 moves along the yoke operating section 83B, and the yoke 83 swings around a yoke shaft 83A in accordance with the recesses and protrusions of the yoke operating section 83B.

The setting wheel lever 84 includes the setting wheel 85, a setting wheel lever shaft 84B, and a setting wheel lever operating hole 84A, into which a setting wheel lever operation shaft 81B, which is so formed as to protrude toward the rear surface of the setting lever 81, is inserted, as shown in FIG. 19. When the winding stem 80 is moved, the setting lever 81 swings, and the setting wheel lever operating shaft 81B moves leftward. In response to the leftward movement, the setting wheel lever 84 swings around the setting wheel lever shaft 84B in accordance with the shape of the setting wheel lever operating hole 84A.

When the winding stem 80 is pulled by one step, the yoke 83 swings clockwise in FIG. 18 and the lower end of the setting lever moves the yoke operating section 83B, so that the yoke 83 swings clockwise. The yoke operating section 83D of the yoke 83 then moves the clutch wheel 86 downward in FIG. 18, and the clutch wheel 86 engages with the setting wheel 85. At this point, since the setting wheel 85 engages with the second calendar corrector wheel 67, as the setting wheel 85 is imaginarily shown in FIG. 9, and when the winding stem 80, which engages with the crown 25, is rotated leftward, the resultant rotary force is transmitted to the clutch wheel 86, the setting wheel 85, the second calendar corrector wheel 67, the calendar corrector wheel 66, and the date corrector setting wheels 64 and 65, so that the date indicator 63 rotates. As a result, the date indicating hand 22 can be corrected.

When the winding stem 80 is pulled by two steps, not only does the setting wheel lever 84 move the setting wheel 85 toward a minute wheel 74 and the setting wheel 85 engages with the minute wheel 74, but the yoke 83 moves the clutch wheel 86 toward the setting wheel 85 and the clutch wheel 86 engages with the setting wheel 85, whereby the time display can be corrected. In the time correction state, since the setting wheel 85 moves toward the minute wheel 74, the setting wheel 85 disengages from the second calendar corrector wheel 67, so that no date correction is made.

When the winding stem 80 is not pulled, a winding pinion 87 engages with a crown wheel that is not shown and rotates the crown wheel, whereby the movement barrel 76, which will be described later, is wound.

The minute wheel 74, a tooth of which engages with a cannon pinion 73 and the hour wheel 70, which make one revolution in one hour, reduces the speed of the rotation of the cannon pinion 73, and transmits the reduced-speed rotation to the hour wheel 70, as shown in FIG. 11. FIG. 12 is a cross-sectional view of the movement 2 taken along the line O-G in FIG. 2. The power reserve transfer geared wheel 44, which is a component of the power reserve display mechanism showing the wound quantity of the movement barrel 76, is provided between the main plate 4 and the second main plate 5, as shown in FIG. 12. The power reserve hand 24 in FIG. 1 is provided at the front end of the power reserve display tube 45. The movement barrel 76 is provided on the rear side of the main plate 4, and the rotation of the movement barrel 76 is transmitted to a center wheel & pinion 72, which engages with a geared wheel 76A of the movement barrel, so that the center wheel & pinion 72 and the cannon pinion 73 simultaneously rotate except that the time correction described above is made.

First Elastic Section and Second Elastic Section

The date indicator driving wheel 62 includes a first elastic section 62D, as shown in FIG. 6. When the crown 25, which engages with the winding stem 80, is operated for date correction, and a tooth of the date indicator 63 comes into contact with the date finger 62C, the elastic section 62D is elastically deformed and therefore absorbs the force that otherwise rotates the date indicator driving wheel 62. Breakage of the date indicator driving wheel 62 can therefore be avoided.

The lunar age indicator driving wheel 52 includes a second elastic section 52D, as shown in FIG. 6. To correct the lunar age, when the button 55 is pressed to rotate the lunar age indicator 40, and a tooth of the lunar age indicator 40 comes into contact with the lunar age finger 52C, the elastic section 52D is elastically deformed and therefore absorbs the force that otherwise rotates the lunar age indicator driving wheel 52. Breakage of the lunar age indicator driving wheel 52 can therefore be avoided. Further, since the first elastic section 62D and the second elastic section 52D allow the date indicator driving wheel 62 or the lunar age indicator driving wheel 52 not to rotate at the time of the date correction or the lunar age correction, the correction can be independently made without synchronization of the date indicator 63 and the lunar age indicator 40 with each other.

Partial Skeleton Section

The partial skeleton section 16, through which members on the side facing the rear surface of the main plate 4 in FIG. 1 are visible from the front side, is decoration that allows the user to see a mechanism specific to a timepiece. In FIG. 8, the main plate 4 has first cutouts 4A. The second main plate 5 has a second main plate opening 5A, which contains the first cutouts 4A and overlaps therewith, as shown in FIG. 3. Further, the cosmetic plate 8, which is attached to the second main plate 5, has a second cutout 8A, which overlaps with the first cutout 4A, as shown in FIG. 2. The dial 10 has an opening 10A, which overlaps with the first cutouts 4A, as shown in FIG. 1. The balance with a hairspring 36, which is located at the rear of the main plate 4, is visible from the front side through the first cutouts 4A, the second main plate cutout 5A, and the second cutout 8A.

In the plan view, inside the opening 10A of the dial 10, at least part of the inner circumference of the cutout 8A of the cosmetic plate 8 is located inside the inner circumference of the first cutout 4A of the main plate 4 in the opening 10A of the dial 10 so that the cosmetic plate 8 covers at least part of the main plate 4, as shown in FIG. 2.

A center wheel bridge 32, which is attached to the main plate 4, is attached to the rear surface of the main plate 4, and a barrel and train wheel bridge 31 is attached below the center wheel bridge 32, as shown in FIG. 4. A balance bridge 33 is attached below the center wheel bridge 32. The balance with a hairspring 36 as one of the drive members is attached to the rear side of the main plate 4. The balance with a hairspring 36 includes, as the components thereof, a hairspring 34, a balance wheel 35, and a jeweled shock-absorbing device 36. The members visible from the front side via the partial skeleton section 16 may be members other than the balance with a hairspring 36 but preferably members relating to movement of the indicating hands, the speed regulation, or the escapement, which give impression appropriate for a timepiece, for improvement in the exterior appearance of the timepiece.

The embodiment described above, in which the date indicator 63 and the lunar age indicator 40 are coaxially guided, allows space saving in the plan view. In addition, since the date indicator driving wheel 62 and the lunar age indicator driving wheel 52, which are driving wheels for the date indicator 63 and the lunar age indicator 40, are coaxially disposed, significant space saving is achieved. The embodiment therefore achieves the configuration in which the partial skeleton section 16 is provided in the 9-o'clock position and the power-reserve-display small window 15 is provided in the 12-o'clock position with the lunar age display and the date display provided but no small window is provided in a 3-o'clock position, as shown in FIG. 1.

Since the second main plate 5, which has recesses and protrusions for guiding and attaching geared wheels and other members, is provided, a larger number of members can be attached to the second main plate 5 by using the strength and the recesses and protrusions thereof than to a simple pressing plate, whereby a function is readily added.

The lunar age correction mechanism includes the lunar age correction transfer level 56 and the lunar age correction lever 57, and the lunar age correction transfer level 56 receives the force from the button 55, and the edge that is part of the transfer lever main plate section 56E and faces the second main plate 5, comes into contact with the second main plate 5. The range over which the lunar age correction transfer level 56 is movable is therefore restricted, so that no excessive force is transmitted to the lunar age correction lever 57, which engages with the lunar age correction transfer level 56, whereby breakage of the lunar age correction lever 57 and the lunar age indicator 40 can be avoided.

Second Embodiment

Figure 20:
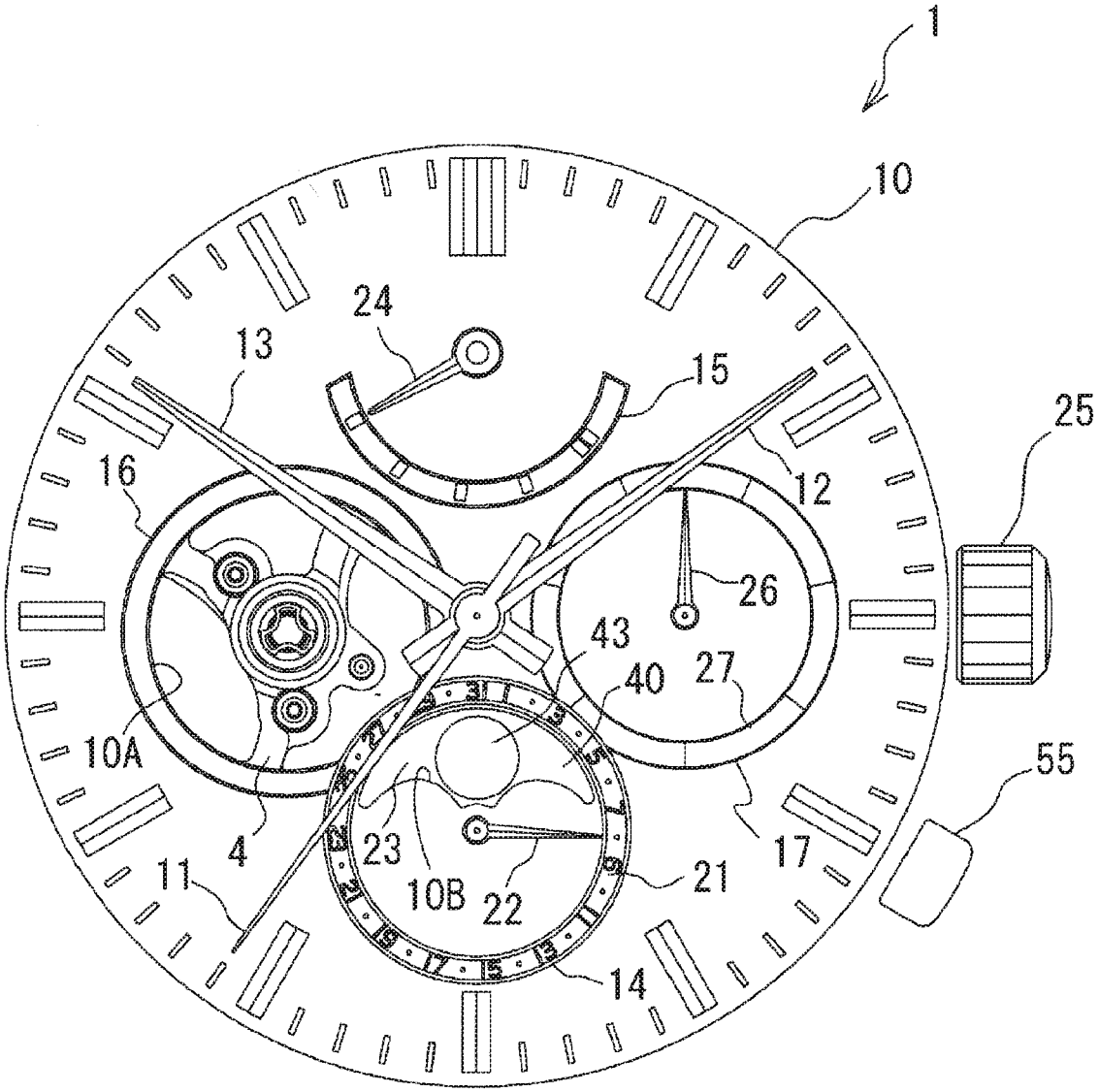
FIG. 20 is a plan view of a display section of a timepiece including a movement according to a second embodiment.

FIG. 20 shows a schematic configuration of a second embodiment of the invention. Members and elements having the same functions as those in the first embodiment have the same reference characters and will not be described. Although not shown in FIG. 20, the timepiece 1 has the exterior case, the cover glass plate, and the case back, as in the first embodiment. The cover glass plate is so attached to the exterior case as to cover the disc-shaped dial 10. In the timepiece 1, the dial 10 is provided as the display section that presents information to the user.

Small Window for Day Display

In the second embodiment, a small window 17 for day display is provided as third display in a 3-o'clock position on the dial 10, as shown in FIG. 20, in addition to the small windows in the first embodiment. The small window 17 is provided with display areas 27, which are divided outer circumferential portions of the small window 17. Although not shown, in the display areas are placed letters standing for the days of the week from Sunday to Saturday, for example, "SU," "MO," "TU," "WE," "TH," "FR," and "SA." A day hand 26 indicates any of the letters described above to perform the day display.

Day Indicator Driving Wheel

Figure 21:
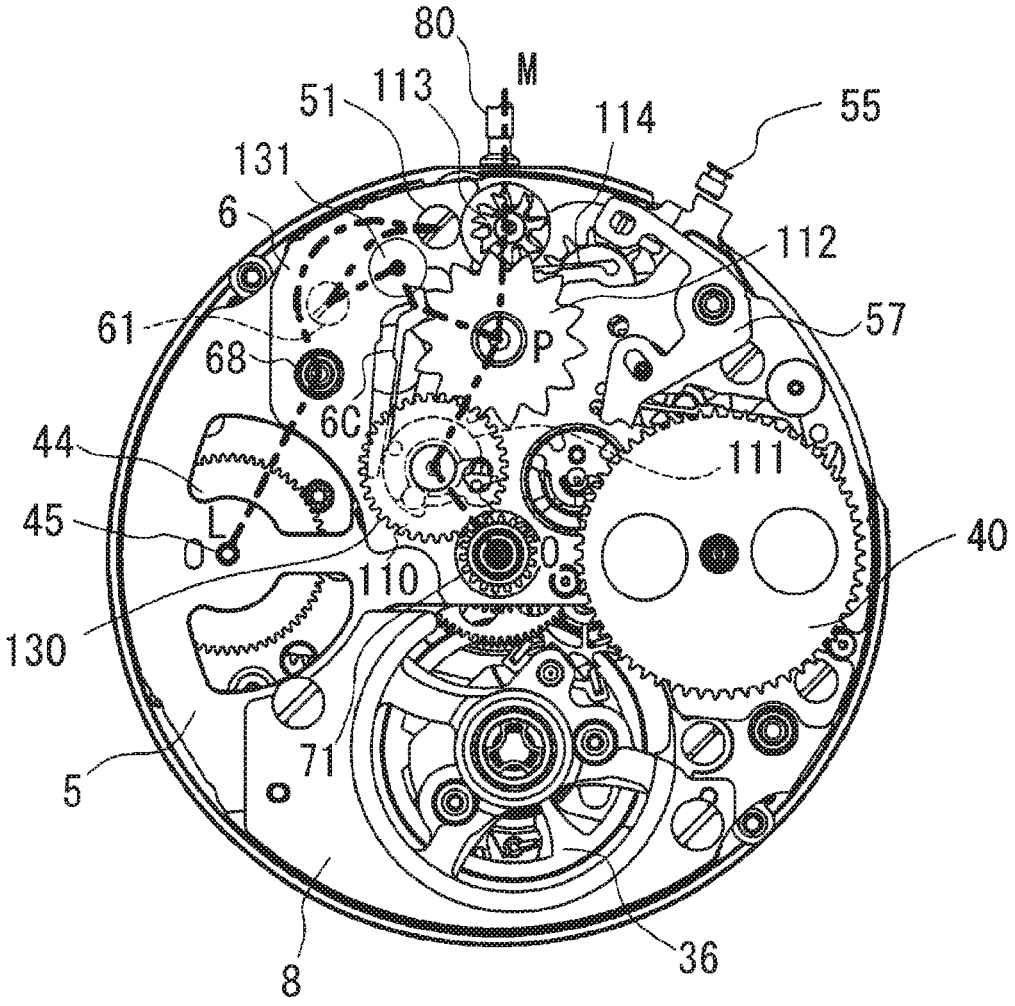
FIG. 21 is a plan view of the movement according to the second embodiment in a state in which the lunar age jumper is removed.
Figure 22:
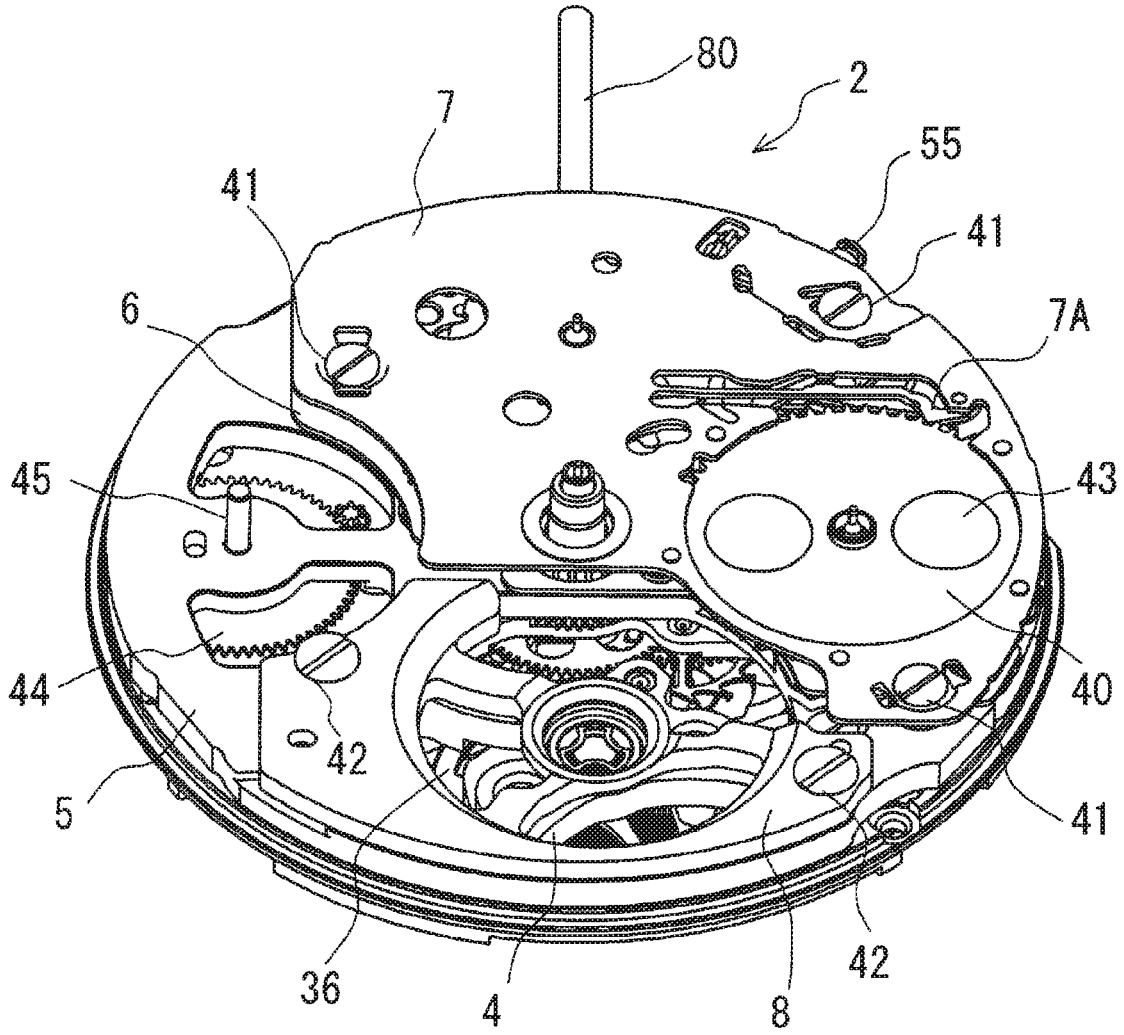
FIG. 22 is a perspective view of the movement according to the second embodiment.

FIG. 21 shows a state in which the lunar age jumper 7 is removed from the movement 2. FIG. 22 is a perspective view of the movement 2. In FIG. 21, the movement 2 includes a day star 112 as a third display wheel and a day indicator driving wheel 130 as a third driving wheel that rotates the day star 112.

Figure 23:
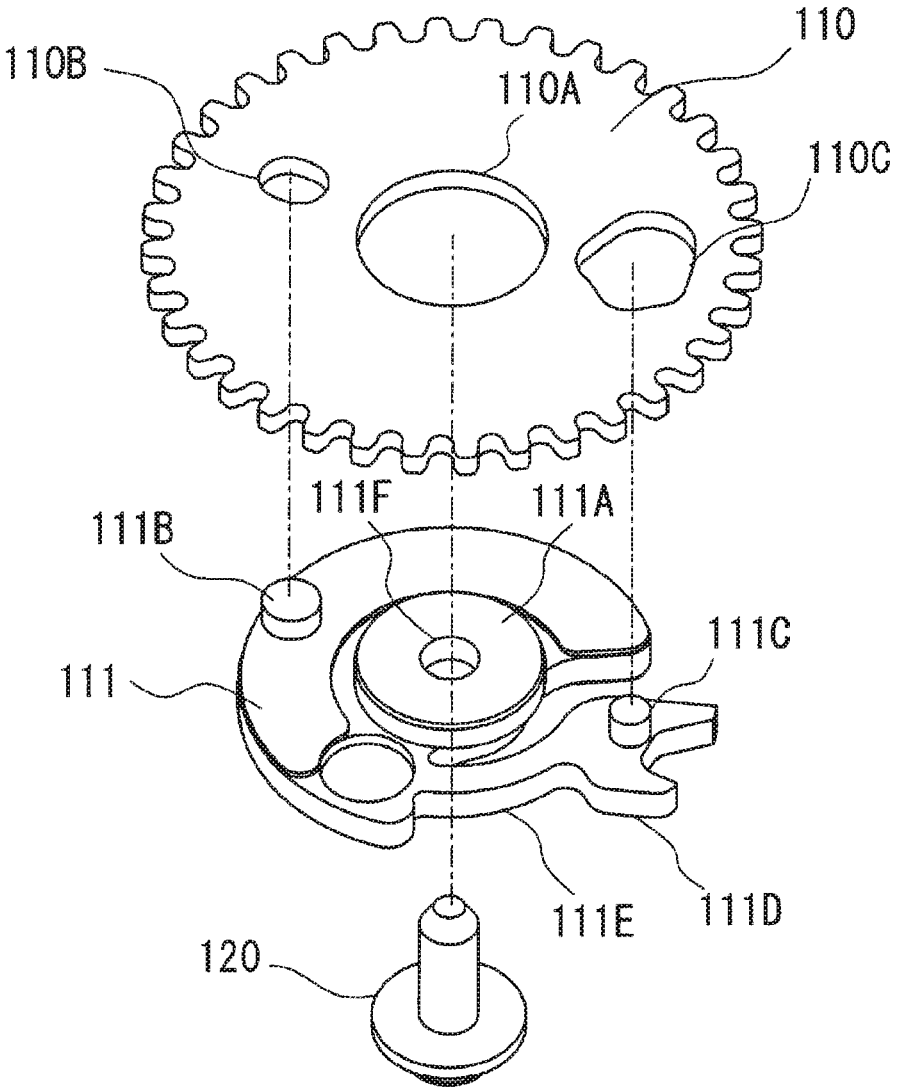
FIG. 23 is a perspective view of a day indicator driving geared wheel, a day finger, and a shaft.
Figure 25:
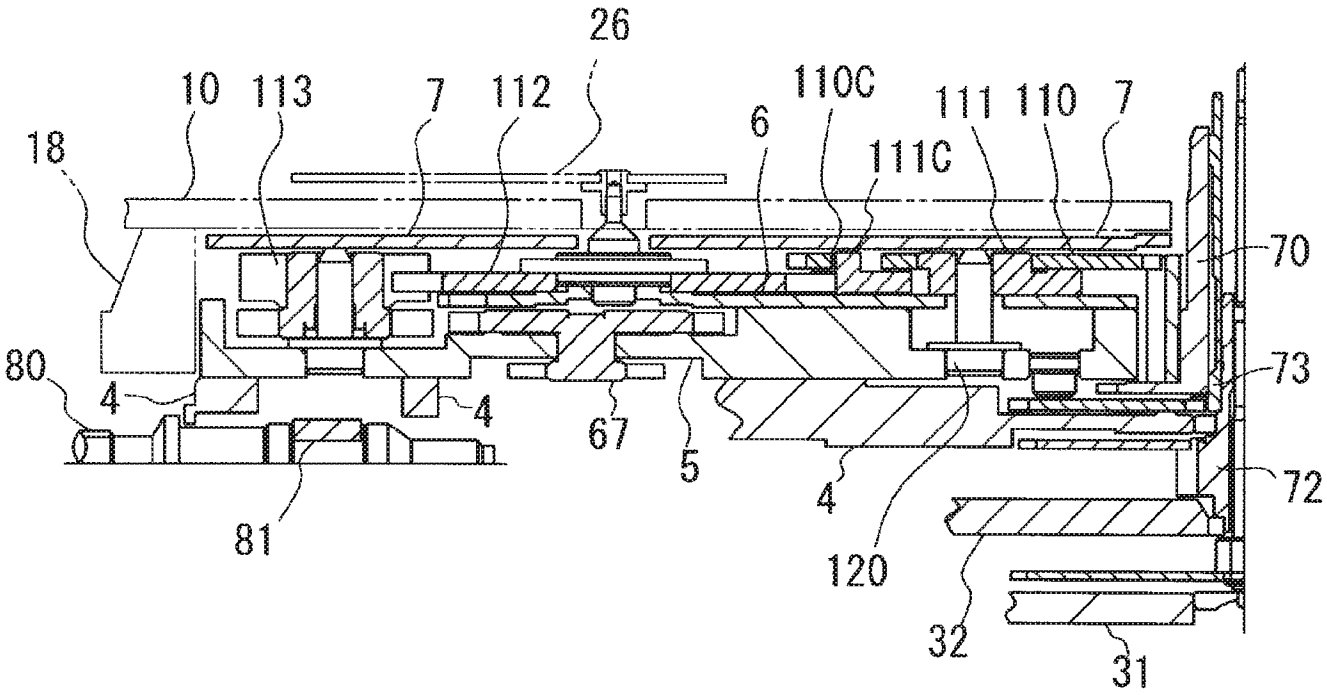
FIG. 25 is a cross-sectional view of the movement taken along a cutting line M-O in FIG. 21.

FIG. 25 is a cross-sectional view of the movement 2 taken along a cutting line M-O in FIG. 21. FIG. 23 is a perspective view of a day indicator driving geared wheel 110 and a day finger 111, which form the day indicator driving wheel 130, along with a shaft 120. The day indicator driving wheel 130 is formed of two members, the day indicator driving geared wheel 110 and the day finger 111. The day finger 111 includes a dowel 111B, which is so formed as to protrude toward the day indicator driving geared wheel 110, a locking section 111C, a day indicator engagement section 111D, an elastic section 111E, and a central protrusion 111A. The day finger 111, the central protrusion 111A of which is inserted into a central hole 110A of the day indicator driving geared wheel 110, guides the day indicator driving geared wheel 110. Further, the day finger 111, the dowel 111B of which is inserted into a dowel receiving hole 110B of the day indicator driving geared wheel 110 and the locking section 111C of which is inserted into a locking section receiving hole 110C of the day indicator driving geared wheel 110, is combined with the day indicator driving geared wheel 110. The shaft 120, which is inserted into a central hole 111F of the day finger 111, guides the day finger 111. The shaft 120 is supported by the second main plate 5, as shown in FIG. 25. The day indicator driving wheel 130 is so rotatably positioned with play (gap) therebetween by the date jumper 6 and the lunar age jumper 7.

Day Star

Figure 26:
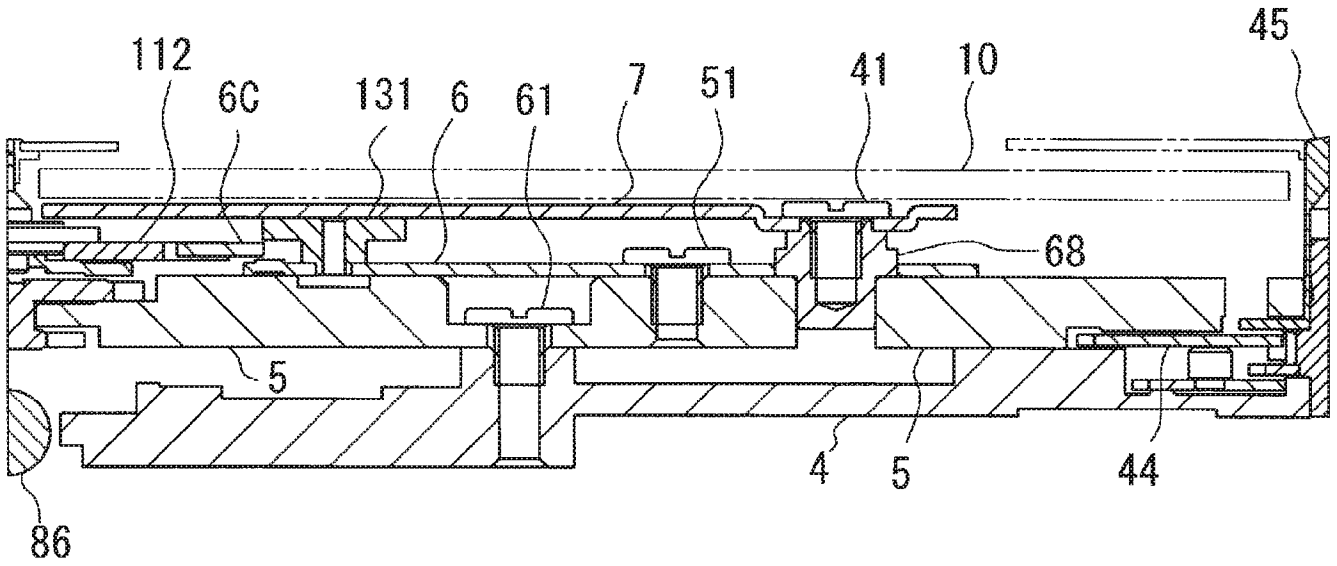
FIG. 26 is a cross-sectional view of the movement taken along a cutting line P-L in FIG. 21.

A tooth of the day indicator driving geared wheel 110 of the day indicator driving wheel 130 engages with the intermediate date wheel 71, and when the intermediate date wheel 71 rotates, the dowel receiving hole 110B and the locking section receiving hole 110C press the dowel 111B and the locking section 111C of the day finger 111, so that the day indicator driving geared wheel 110 rotates the day finger 111. Speed reduction is so made that the intermediate date wheel 71 makes one revolution in 12 hours and the day indicator driving wheel 130 makes one revolution in 24 hours. When the day indicator driving wheel 130 makes one revolution, the day indicator engagement section 111D of the day finger 111 engages with a tooth of the day star 112 to advance the day star 112 by the amount corresponding to two teeth. The day hand 26 is attached to the shaft of the day star 112, and when the day star 112 advances by the amount corresponding to two teeth, the day display advances by one day. A jumper section 6C of the date jumper 6 engages with a tooth of the day star 112 to determine the rotary direction of the day star 112, as shown in FIG. 21. The day star 112 is therefore intermittently rotatable once a day. The jumper section 6C is positioned with play (gap) by the date jumper 6 and a jumper seating 131, as shown in FIG. 26.

Day Correction Mechanism

Figure 24:
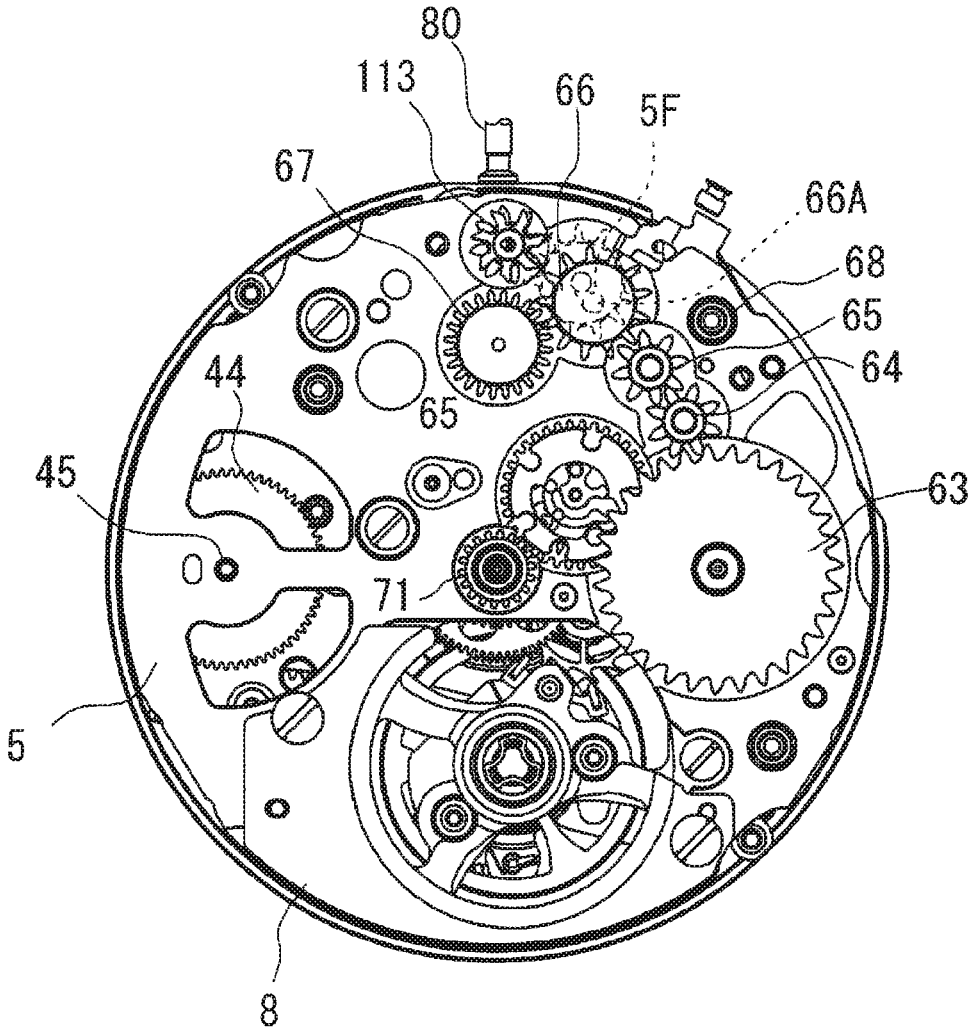
FIG. 24 is a plan view of the movement according to the second embodiment with the date jumper removed.

The day star 112 engages with a day corrector wheel 113, as shown in FIGS. 21 and 25. FIG. 24 shows the motion of the calendar corrector wheel 66 with the date jumper 6 removed. The calendar corrector wheel 66, a shaft 66A of which is inserted into an elongated hole 5F of the second main plate 5, is guided by the elongated hole 5F, as shown in FIG. 24. The mechanisms of the setting lever and other components in the case where the winding stem 80 in the first layer is pulled are the same as those in the first embodiment shown in FIG. 8. In the state in which the winding stem 80 is pulled by one step, the clutch wheel 86 engages with the setting wheel 85, and the setting wheel 85 (integrated with calendar correction transfer wheel) engages with the second calendar corrector wheel 67. When the winding stem 80 is then rotated clockwise, the second calendar corrector wheel 67 rotates clockwise in the plan view (in the plane of FIG. 24) via the setting wheel 85, whereby the calendar corrector wheel 66 moves toward the date corrector wheel 65 and engages therewith, as indicated by the solid line in FIG. 24, and the date indicator 63 rotates to correct the date. On the other hand, when the winding stem 80 is rotated counterclockwise, the second calendar corrector wheel 67 rotates counterclockwise in the plan view via the setting wheel 85. When the second calendar corrector wheel 67 rotates counterclockwise in the plan view, the calendar corrector wheel 66 moves toward the day corrector wheel 113, as indicated by the phantom line in FIG. 24, engages with the day corrector wheel 113, and rotates. At this point, since the day corrector wheel 113 engages both with the calendar corrector wheel 66 and the day star 112, the day star rotates clockwise. The actions described above allow day correction.

When the day corrector wheel 113 rotates clockwise for the day correction, and the day indicator engagement section 111D of the day finger 111 of the day indicator driving wheel 130 comes into contact with a tooth of the day corrector wheel 113, the elastic section 111E is elastically deformed toward the shaft of the day finger 111 to absorb the rotary force from the day indicator driving wheel 130. Therefore, when the day corrector wheel 113 undergoes the correction, no force that causes the day indicator driving wheel 130 to rotate in the opposite direction is transmitted from the day corrector wheel 113 to the day indicator driving wheel 130. The elastic section 111E therefore prevents breakage of the day corrector wheel 113 and the member that engages therewith. Further, the locking section receiving hole 110C is so formed as to be large enough to allow the movement of the locking section 111C when the elastic section 111E is elastically deformed at the time of the day correction. In FIG. 21, the date jumper 6 includes an elastic section 114, which presses the calendar corrector wheel 66 from the side facing the front surface thereof to axially position the calendar corrector wheel 66.

Sign

Figure 27:
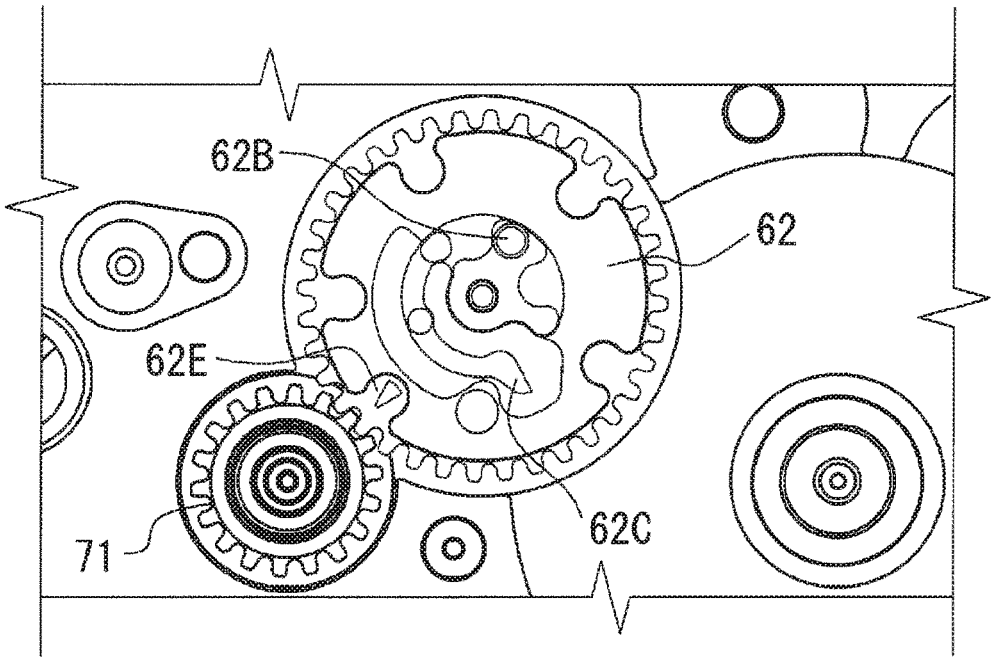
FIG. 27 is a plan view showing a state in which a date indicator driving wheel is incorporated into the movement.

FIG. 27 shows a state during the assembly of the movement 2 but immediately after the date indicator driving wheel 62 is incorporated into the movement 2. The phase between the date indicator driving wheel 62 and the intermediate date wheel 71 needs to be so adjusted that the date indicator driving wheel 62 rotates the date indicator 63 at a desired timing. The date indicator driving wheel 62 has a sign 62E on the front surface thereof. The position of the sign 62E is so presented in advance that placing the date indicator driving wheel 62 in such a way that the sign faces the shaft of the intermediate date wheel 71 allows desired phase adjustment. The sign 62E allows the assembly worker to make the phase adjustment only by aligning the sign 62E in the assembly work in no strict consideration of the phase adjustment. The assembly work is therefore readily performed. In the present embodiment, the sign 62E is a sign facing the shaft of the intermediate date wheel 71, and the sign 62E may instead be so set as to face another target because the target that the sign 62E faces only needs to be a portion that does not move when the movement 2 is driven.

Figure 28:
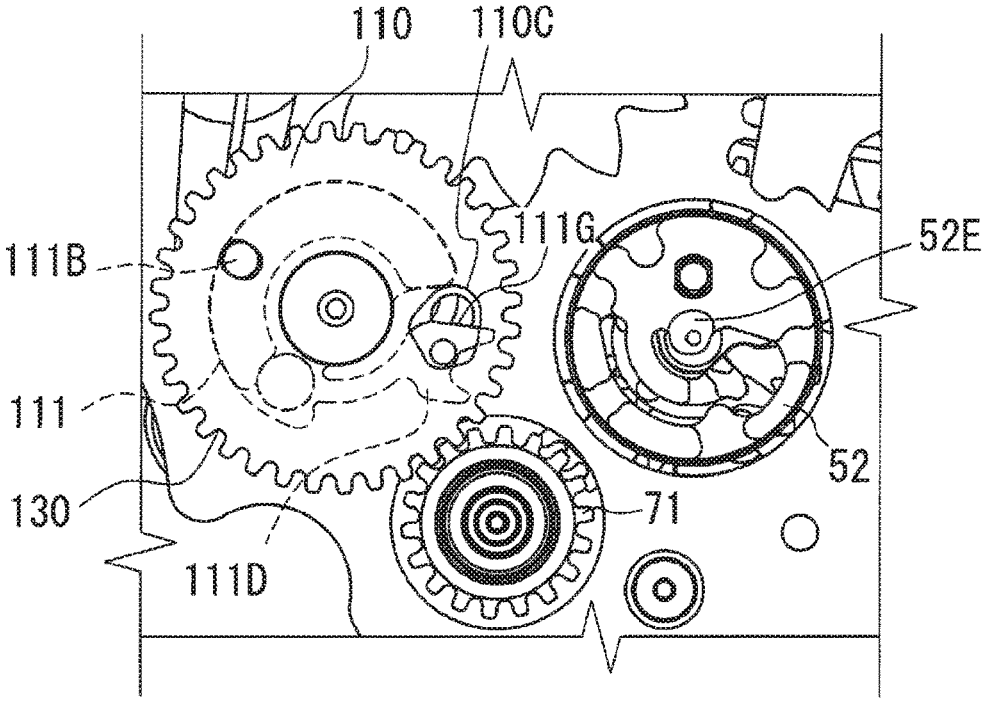
FIG. 28 is a plan view showing a state in which a day indicator driving wheel is incorporated into the movement.

FIG. 28 shows a state during the assembly of the movement 2 but immediately after the day indicator driving wheel 130 is incorporated into the movement 2. Since the day indicator driving wheel 130 also needs to rotate the day star 112 at a desired timing, the phase between the day indicator driving wheel 130 and the intermediate date wheel 71 needs to be adjusted. To perform the desired phase adjustment, an end portion 111G of the day finger 111 is provided as a sign. The end portion 111G is an end portion separate counterclockwise from the day indicator engagement section 111D and visible from above through the locking section receiving hole 110C of the day indicator driving geared wheel 110, and placing the day finger 111 in such a way that the central protrusion 52E of the lunar age indicator driving wheel 52 is located on an extension of the straight line of the end portion 111G allows the desired phase adjustment. Since the end portion 111G serves as the sign at the time of placement, the assembly worker can make the phase adjustment only by aligning the position of the end portion 111G as the sign in the assembly work in no strict consideration of the phase adjustment. The assembly work is therefore readily performed. The end portion 111G used as the sign is not necessarily engraved or printed but may be displayed as the sign.

Figure 29:
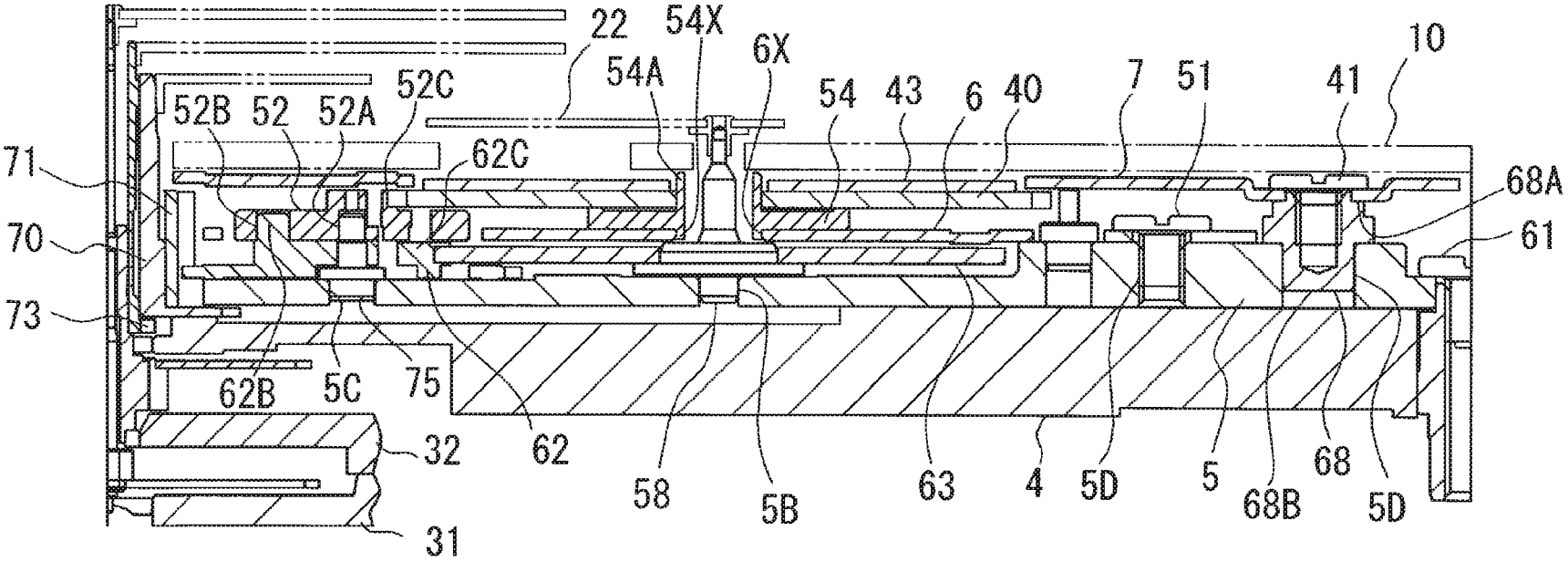
FIG. 29 is a cross-sectional view of the movement taken along the line O-B-C-D-E-F in FIG. 2 in an embodiment in which a lunar age indicator guide seating is fixed to the date jumper.

FIG. 29 corresponds to FIG. 10 described above and is a cross-sectional view in an embodiment in which the lunar age indicator guide seating 54 is fixed to the date jumper 6 (that is, corresponding to the cross-sectional view of the movement 2 taken along the cutting line O-B-C-D-E in FIG. 2). In FIG. 29, a guide section 6X provided in the date jumper 6 forms a hole coaxial with the date indicator 63. The lunar age indicator guide seating 54 includes a falling section 54X, which is an extension of the rising section 54A that extends from the rear surface of the lunar age indicator guide seating 54. Fitting the falling section 54X of the lunar age indicator guide seating 54 into the guide section 6X allows the lunar age indicator guide seating 54 to be fixed to the date jumper 6. The lunar age indicator 40 is coaxially attached to the date indicator 63 with the lunar age indicator 40 so guided by the rising section 54A as to slidable relative to the lunar age indicator guide seating 54. Even in the configuration in which the lunar age indicator guide seating 54 is fixed to the date jumper 6 and the lunar age indicator 40 is slidable relative to the lunar age indicator guide seating 54 as described above, the date indicator 63 and the lunar age indicator 40 are allowed to coaxially and separately pivot with the date indicator 63 and the lunar age indicator 40 axially separate from each other.

Figure 30:
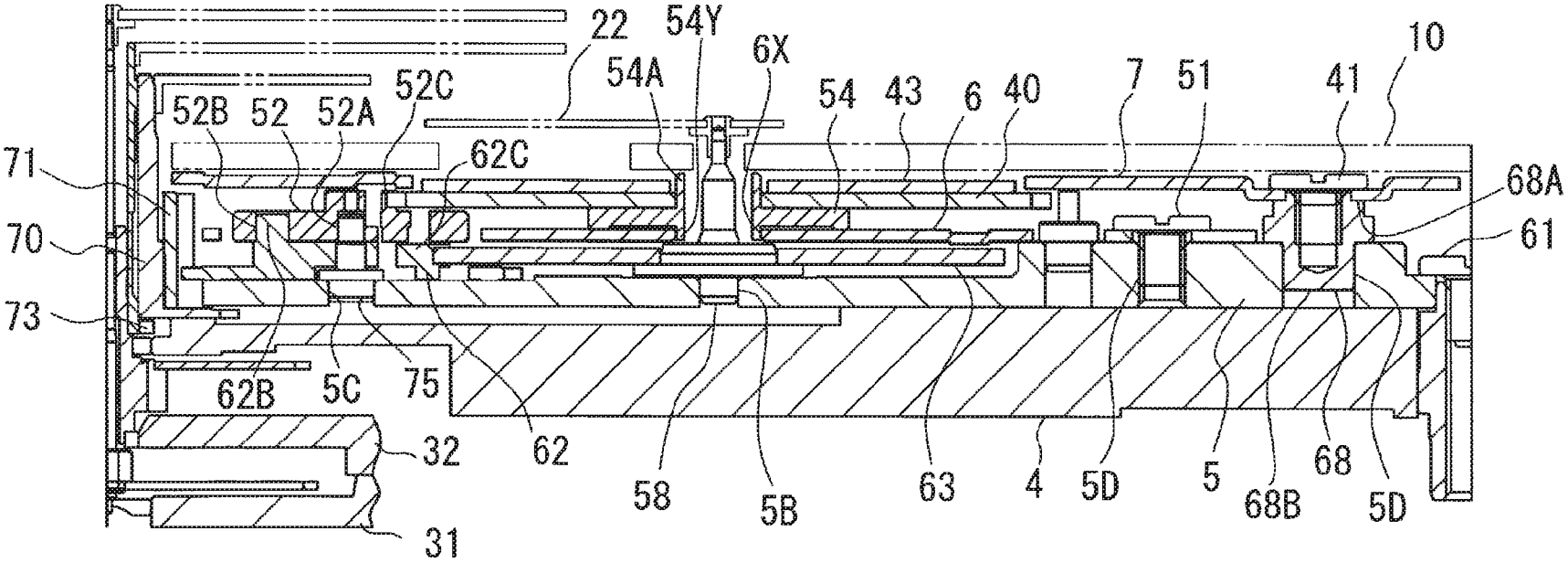
FIG. 30 is a cross-sectional view of the movement taken along the line O-B-C-D-E in FIG. 2 in an embodiment in which the lunar age indicator guide seating rotates integrally with the lunar age indicator.

FIG. 30 corresponds to FIG. 10 and is a cross-sectional view in an embodiment in which the lunar age indicator guide seating 54 rotates integrally with the lunar age indicator 40 (that is, corresponding to the cross-sectional view of the movement 2 taken along the cutting line O-B-C-D-E in FIG. 2). In FIG. 30, the guide section 6X provided in the date jumper 6 forms the hole coaxial with the date indicator 63. The lunar age indicator guide seating 54 includes a tubular falling section 54Y, which is an extension of the rising section 54A that extends from the rear surface of the lunar age indicator guide seating 54. The falling section 54Y of the lunar age indicator guide seating 54 is guided by the guide section 6X, so that the lunar age indicator guide seating 54 is slidably attached to the date jumper 6. The rising section 54A of the lunar age indicator guide seating 54 is fit into the lunar age indicator 40, so that the lunar age indicator 40 is coaxially attached to the date indicator 63. The lunar age indicator 40 and the lunar age indicator guide seating 54 are so attached as not to rotate relative to each other. The lunar age indicator 40 and the lunar age indicator guide seating 54, for example, may be so fixed to each other that they are welded to each other and therefore rotate integrally with each other or may be so fixed to each other with a fixing finger or dowel or any other engaging component as to rotate integrally with each other. Still instead, the lunar age indicator 40 and the lunar age indicator guide seating 54 may be integrally molded in a molding step. Even in the configuration in which the lunar age indicator guide seating 54 is slidably rotatable relative to the date jumper 6 and the lunar age indicator 40 and the lunar age indicator guide seating 54 rotate integrally with each other as described above, the date indicator 63 and the lunar age indicator 40 are allowed to coaxially and separately pivot with the date indicator 63 and the lunar age indicator 40 axially separate from each other.

In the present embodiment, the date hand and the lunar age are switched at the same timing. The phase of the switching of the day hand is so adjusted that the day hand is switched at a timing different from the timing when the date hand and the lunar age are switched. The reason for this is that if the three types of switching operation are simultaneously performed, a large load acts on the movement barrel 76 via the intermediate date wheel 71, and such a large load is preferably avoided. For example, in the present embodiment, the day hand is switched after the date hand and the lunar age are switched by the amount corresponding to one tooth of the intermediate date wheel 71. Since the intermediate date wheel 71 has 18 teeth, the shift of one tooth corresponds to 40 minutes in terms of the length of time.

The present embodiment, in which the day correction mechanism including the day corrector wheel 113 is provided, allows the day correction independent of the date correction and lunar age correction mechanisms.

In the present embodiment, the first display wheel is the date indicator 63, the second display wheel is the lunar age indicator 40, and the third display wheel is the day star 112. Instead, the first to third display wheels may be changed to one another or may be other display wheels.

The invention is also applicable to a timepiece driven with a motor as well as a mechanical timepiece. Further, the invention is not limited to the embodiments described above, and a variety of changes and additions can be made to any of the specific configurations in the embodiments described above within the scope of the substance of the invention.

The entire disclosure of Japanese Patent Application No. 2017-111053, filed Jun. 5, 2017 is expressly incorporated by reference herein.

What is claimed is:

1. A timepiece movement comprising:

a first display wheel for first display;

a second display wheel for second display;

a first driving wheel that engages with and rotates the first display wheel;

a second driving wheel that engages with and rotates the second display wheel;

a first pressing member provided between the first display wheel and the second display wheel; and a second pressing member that presses the second display wheel from a side facing a front surface thereof, wherein the first display wheel and the second display wheel are coaxially disposed, the first driving wheel and the second driving wheel are coaxially disposed, the second display wheel is guided coaxially with the first display wheel in a region between the first pressing member and the second pressing member by a guide section provided in the first pressing member and is si disposed as to be axially separate from the first display wheel, and the first display wheel and the second display wheel separately pivot.

2. The timepiece movement according claim 1, further comprising a second display wheel guide seating so provided on a side of the second display wheel, the side facing the first pressing member, as to be slidable relative to at least one of the first pressing member and the second pressing member, wherein the first pressing member has a tubular section as the guide section so provided as to axially protrude into a tubular shape coaxial with the first display wheel, the second display wheel guide seating is guided by the tubular section coaxially with the first display wheel, and the second display wheel is attached coaxially with the second display wheel guide seating.

3. The timepiece movement according to claim 1, wherein one of the first driving wheel and the second driving wheel has a dowel so formed as to axially protrude, another one of the first driving wheel and the second driving wheel has a dowel receiving hole into which the dowel is inserted, the dowel of the first driving wheel or the second driving wheel is inserted into the dowel receiving hole in the second driving wheel or the first driving wheel, and one of the first driving wheel and the second driving wheel is provided with a toothed section that engages with another geared wheel.

4. The timepiece movement according to claim 1, further comprising:

a correction transfer lever that includes a transfer lever main plate section and a reception section pressed by a pressing section and is so provided in the movement as to be pivotable around a first fixing member as a pivotal axis perpendicularly to an axial direction of the pivotal axis; and a correction lever that includes a correction lever main plate section and a correction section that comes into contact with a tooth of the second display wheel, is so provided in the movement as to be pivotable around a second fixing member as a pivotal axis perpendicularly to an axial direction of the pivotal axis, and causes the second display wheel to pivot, wherein one of the correction transfer lever and the correction lever has an engagement section so provided as to protrude toward another of the correction transfer lever and the correction lever or a reception hole that engages with the engagement section, the transfer lever main plate section and the correction lever main plate section are so disposed as to be parallel to a plane perpendicular to the axial direction, and when the reception section of the correction transfer lever is pressed by the pressing member so that the correction transfer lever pivots, the correction lever pivots and the correction section of the correction lever therefore comes into contact with a tooth of the second display wheel so that the second display wheel pivots.

5. The timepiece movement according to claim 1, wherein the first driving wheel includes a first driving finger that engages the first display wheel, the first driving wheel further includes a first elastic section deformed when a tooth of the first display wheel comes into contact with the first driving finger for correction of the first display wheel to avoid rotation of the first driving wheel, the second driving wheel includes a second driving finger that engages with the second display wheel, and the second driving wheel further includes a second elastic section deformed when a tooth of the second display wheel comes into contact with the second driving finger for correction of the second display wheel to avoid rotation of the second driving wheel.

6. The timepiece movement according to claim 1, further comprising a second main plate having recesses and protrusions to which a member is attached, the second main plate attached to a front surface of a main plate of the movement.

7. The movement according to claim 6, wherein the first display is date display, the first display wheel is a date indicator, the first driving wheel is a date indicator driving wheel, the second display is lunar age display, the second display wheel is a lunar age indicator, and the second driving wheel is a lunar age indicator driving wheel.

8. A timepiece movement comprising:

a first display wheel for first display;

a second display wheel for second display;

a first driving wheel that engages with and rotates the first display wheel;

a second driving wheel that engages with and rotates the second display wheel;

a correction transfer lever that includes a transfer lever main plate section and a reception section pressed by a pressing section and is so provided in the movement as to be pivotable around a first fixing member as a pivotal axis perpendicularly to an axial direction of the pivotal axis; and a correction lever that includes a correction lever main plate section and a correction section that comes into contact with a tooth of the second display wheel, is so provided in the movement as to be pivotable around a second fixing member as a pivotal axis perpendicularly to an axial direction of the pivotal axis, and causes the second display wheel to pivot, wherein the first display wheel and the second display wheel are coaxially disposed, the first driving wheel and the second driving wheel are coaxially disposed, one of the correction transfer lever and the correction lever has an engagement section so provided as to protrude toward another of the correction transfer lever and the correction lever or a reception hole that engages with the engagement section, the transfer lever main plate section and the correction lever main plate section are so disposed as to be parallel to a plane perpendicular to the axial direction, and when the reception section of the correction transfer lever is pressed by the pressing member so that the correction transfer lever pivots, the correction lever pivots and the correction section of the correction lever therefore comes into contact with a tooth of the second display wheel so that the second display wheel pivots.

9. A timepiece movement comprising:

a first display wheel for first display;

a second display wheel for second display;

a first driving wheel that engages with and rotates the first display wheel; and a second driving wheel that engages with and rotates the second display wheel, wherein the first display wheel and the second display wheel are coaxially disposed, the first driving wheel and the second driving wheel are coaxially disposed, the first driving wheel includes a first driving finger that engages the first display wheel, the first driving wheel further includes a first elastic section deformed when a tooth of the first display wheel comes into contact with the first driving finger for correction of the first display wheel to avoid rotation of the first driving wheel, the second driving wheel includes a second driving finger that engages with the second display wheel, and the second driving wheel further includes a second elastic section deformed when a tooth of the second display wheel comes into contact with the second driving finger for correction of the second display wheel to avoid rotation of the second driving wheel.

* * * * *